US009920622B2

(12) United States Patent
Switzer et al.

(10) Patent No.: US 9,920,622 B2
(45) Date of Patent: Mar. 20, 2018

(54) TRANSMITTING DATA ACROSS ELECTRICALLY INSULATING GAPS IN A DRILL STRING

(71) Applicant: EVOLUTION ENGINEERING INC., Calgary (CA)

(72) Inventors: David A. Switzer, Calgary (CA); Aaron W. Logan, Calgary (CA); Jili (Jerry) Liu, Calgary (CA); Mojtaba Kazemi Miraki, Calgary (CA)

(73) Assignee: Evolution Engineering Inc., Calgary (CA)

( * ) Notice: Subject to any disclaimer, the term of this patent is extended or adjusted under 35 U.S.C. 154(b) by 69 days.

(21) Appl. No.: 14/916,678

(22) PCT Filed: Sep. 5, 2013

(86) PCT No.: PCT/CA2013/050683
§ 371 (c)(1),
(2) Date: Mar. 4, 2016

(87) PCT Pub. No.: WO2015/031973
PCT Pub. Date: Mar. 12, 2015

(65) Prior Publication Data

US 2016/0194953 A1 Jul. 7, 2016

(51) Int. Cl.
*G01V 3/00* (2006.01)
*E21B 47/12* (2012.01)
*E21B 17/00* (2006.01)

(52) U.S. Cl.
CPC ..... *E21B 47/122* (2013.01); *E21B 17/003* (2013.01)

(58) Field of Classification Search
None
See application file for complete search history.

(56) References Cited

U.S. PATENT DOCUMENTS 3,889,228 A * 6/1975 Shawhan ..... E21B 47/16 367/82
4,562,559 A * 12/1985 Sharp ..... E21B 47/16 175/40

(Continued)

FOREIGN PATENT DOCUMENTS

WO 2009032163 A1 3/2009
WO 2009048768 A2 4/2009

(Continued)

*Primary Examiner* — Curtis King
(74) *Attorney, Agent, or Firm* — Oyen Wiggs Green & Mutala LLP

(57) ABSTRACT

A range of apparatus and methods for providing local and long range data telemetry within a wellbore is described. These apparatus and methods may be combined in a wide variety of ways. In some embodiments data is transmitted across a gap in a drill string using signals of a higher frequency for which an electrical impedance of the gap or of a filter connected across the gap is low. Low-frequency EM telemetry signals may be applied across the gap. The gap and any filter connected across the gap present a high impedance to the low-frequency EM telemetry signals. The described technology may be applied for transferring sensor readings between downhole electrical packages. In some embodiments sensors are electrically connected across electrically insulating gaps in the drill string.

42 Claims, 15 Drawing Sheets

(56) References Cited

U.S. PATENT DOCUMENTS 4,800,385 A * 1/1989 Yamazaki ..... E21B 47/122 175/40
5,091,725 A * 2/1992 Gard ..... E21B 47/122 324/369
5,128,901 A * 7/1992 Drumheller ..... E21B 47/16 340/854.3
5,881,310 A * 3/1999 Airhart ..... E21B 47/124 710/3
5,883,516 A * 3/1999 Van Steenwyk ..... G01V 3/20 175/50
6,018,301 A * 1/2000 Smith ..... E21B 47/011 340/853.7
6,396,276 B1 * 5/2002 Van Steenwyk ..... E21B 47/122 175/50
6,439,324 B1 8/2002 Ringgenberg et al.
6,781,521 B1 * 8/2004 Gardner ..... E21B 47/121 333/18
6,866,306 B2 3/2005 Boyle et al.
6,992,554 B2 1/2006 Hall et al.
7,362,235 B1 4/2008 Normann et al.
7,411,517 B2 8/2008 Flanagan
7,880,640 B2 2/2011 Lovell et al.
8,102,276 B2 1/2012 Sugiura
8,284,075 B2 10/2012 Fincher et al.
8,334,786 B2 12/2012 Bowles et al.
2003/0058127 A1 * 3/2003 Babour ..... G01V 11/002 340/854.3
2003/0102980 A1 * 6/2003 Koro ..... E21B 47/122 340/853.7
2004/0104047 A1 * 6/2004 Peter ..... E21B 17/003 175/40
2004/0163822 A1 8/2004 Zhang et al.
2005/0068703 A1 * 3/2005 Dopf ..... E21B 17/003 361/66
2006/0022840 A1 * 2/2006 Spring ..... E21B 17/003 340/854.3
2006/0035591 A1 * 2/2006 Young ..... E21B 47/12 455/63.1
2006/0041795 A1 * 2/2006 Gabelmann ..... G01V 3/34 714/699
2006/0086536 A1 * 4/2006 Boyle ..... E21B 7/068 175/40
2006/0124297 A1 * 6/2006 Ohmer ..... E21B 17/003 166/250.01
2007/0052551 A1 * 3/2007 Lovell ..... G01V 11/002 340/854.6
2007/0247328 A1 * 10/2007 Petrovic ..... G01V 11/002 340/853.7
2008/0156534 A1 * 7/2008 Clark ..... E21B 47/01 175/45
2008/0191900 A1 * 8/2008 Camwell ..... E21B 17/028 340/854.3
2008/0245570 A1 10/2008 Partouche
2009/0058675 A1 3/2009 Sugiura
2009/0236144 A1 * 9/2009 Todd ..... E21B 17/01 175/5
2010/0097279 A1 * 4/2010 Signorelli ..... E21B 47/01 343/720
2010/0175890 A1 7/2010 Bray et al.
2011/0168446 A1 * 7/2011 Lemenager ..... E21B 47/12 175/50
2011/0247803 A1 * 10/2011 Rodney ..... G01V 11/002 166/254.2
2011/0254695 A1 * 10/2011 Camwell ..... E21B 17/003 340/854.6
2012/0090827 A1 4/2012 Sugiura
2013/0032403 A1 * 2/2013 Rozenblit ..... E21B 41/0085 175/40
2013/0057412 A1 * 3/2013 Gard ..... G01V 11/002 340/854.9
2013/0063276 A1 3/2013 Zientarski
2013/0106615 A1 * 5/2013 Prammer ..... G01V 3/30 340/854.6
2014/0002089 A1 * 1/2014 Wood ..... G01V 3/20 324/366
2014/0102792 A1 * 4/2014 Lachner, Jr. ..... E21B 7/002 175/40
2014/0124269 A1 * 5/2014 Logan ..... E21B 47/011 175/325.1
2014/0131994 A1 * 5/2014 Holmen ..... F16L 25/021 285/47
2014/0132271 A1 * 5/2014 Liu ..... G01V 3/20 324/338
2015/0002307 A1 * 1/2015 Graf ..... E21B 47/122 340/854.4
2015/0107900 A1 * 4/2015 Wang ..... E21B 17/003 175/40
2015/0247401 A1 * 9/2015 Cramer ..... E21B 47/122 324/338
2015/0268371 A1 * 9/2015 Donderici ..... G01V 3/26 324/346
2016/0265343 A1 * 9/2016 Donderici ..... E21B 43/305
2016/0273337 A1 * 9/2016 Donderici ..... E21B 47/02216

FOREIGN PATENT DOCUMENTS

WO 2009086637 A1 7/2009
WO 20090143405 A2 11/2009
WO 2010065205 A1 6/2010
WO 2010121344 A1 10/2010
WO 2010121345 A1 10/2010

* cited by examiner

TRANSMITTING DATA ACROSS ELECTRICALLY INSULATING GAPS IN A DRILL STRING

FIELD

This disclosure relates generally to subsurface drilling. Embodiments provide methods and apparatus for transmitting data between parts of a drill string that are electrically insulated from one another. For example, some embodiments apply the present teachings to transmit data across gap sub assemblies. Some embodiments provide gap sub assemblies suitable for providing electromagnetic telemetry in measurement while drilling (MWD) and/or logging while drilling (LWD) applications.

BACKGROUND

Recovering hydrocarbons from subterranean zones relies on drilling wellbores. In subsurface drilling, drilling equipment situated at the surface drives a drill string to extend from the surface equipment to the formation or subterranean zone of interest. The drill string is typically made up of metallic tubulars. The drill string may extend thousands of feet or meters below the surface. The terminal end of the drill string includes a drill bit for drilling, or extending, the wellbore.

The surface equipment typically includes some sort of drilling fluid system. In most cases a drilling "mud" is pumped through the inside of the drill string. The drilling mud cools and lubricates the drill bit, exits the drill bit and carries rock cuttings back to the surface. The mud also helps control bottom hole pressure and prevents hydrocarbon influx from the formation into the wellbore and potential blow out at the surface.

Directional drilling permits the path of a wellbore to be steered. Directional drilling may be applied to steer a well from vertical to intersect a target endpoint or to follow a prescribed path. A bottom hole assembly (BHA) at the terminal end of the drillstring may include 1) the drill bit; 2) a steerable downhole mud motor of a rotary steerable system; 3) sensors of survey equipment for logging while drilling (LWD) and/or measurement while drilling (MWD) to evaluate downhole conditions as drilling progresses; 4) apparatus for telemetry of data to the surface; and 5) other control equipment such as stabilizers or heavy weight drill collars.

MWD equipment may be used to provide downhole sensor and status information at the surface while drilling in a near real-time mode. This information may be used by the rig crew to make decisions about controlling and steering the well to optimize the drilling speed and trajectory based on numerous factors, including lease boundaries, existing wells, formation properties, hydrocarbon size and location. These decisions can include making intentional deviations from the planned wellbore path as necessary, based on the information gathered from the downhole sensors during the drilling process. In its ability to obtain real time data, MWD allows for a relatively more economical and efficient drilling operation.

Various telemetry methods may be used to send data from MWD or LWD sensors back to the surface. Such telemetry methods include, but are not limited to, the use of hardwired drill pipe, acoustic telemetry, use of fibre optic cable, mud pulse (MP) telemetry and electromagnetic (EM) telemetry.

EM telemetry involves the generation of electromagnetic waves at the wellbore which travel through the earth and are detected at the surface.

Advantages of EM telemetry relative to MP telemetry, include generally faster data rates, increased reliability due to no moving downhole parts, high resistance to lost circulating material (LCM) use, and suitability for air/underbalanced drilling. An EM system can transmit data without a continuous fluid column; hence EM telemetry can be used when there is no mud flowing. This is advantageous when the drill crew is adding a new section of drill pipe as the EM signal can transmit the directional survey while the drill crew is adding the new pipe.

Disadvantages of EM telemetry include lower depth capability, incompatibility with some formations (for example, high salt formations and formations of high resistivity contrast), and some market resistance due to acceptance of older established methods. Also, as the EM transmission is strongly attenuated over long distances through the earth formations, it requires a relatively large amount of power so that the signals are detected at surface. Higher frequency signals attenuate faster than low frequency signals.

A metallic tubular is generally used as the dipole antennae for an EM telemetry tool by dividing the drill string into two conductive sections by an insulating joint or connector which is known in the art as a "gap sub".

WO 2010/121344 and WO 2010/121345 describe drill bit assembly systems which incorporate channels through an electrically isolating gap between the drill bit head and pin body to provide a feed through for a wire that may carry information for uplink communication from the drill bit, or downlink communication from an uphole EM gap subassembly. WO 2009/086637 describes a gap sub having an insulated wire extending through the gap sub.

U.S. Pat. No. 6,866,306, U.S. Pat. No. 6,992,554, U.S. Pat. No. 7,362,235, US2009/0058675, US2010/0175890, US2012/0090827, US2013/0063276 and WO2009/032163 disclose various constructions for carrying data signals between sections of a drill string. WO2009/0143405 and WO2010/065205 disclose the use of repeaters to transmit signals along a drill string. US 2008/0245570; WO 2009/048768A2; U.S. Pat. No. 7,411,517; US2004/0163822A1; and U.S. Pat. No. 8,334,786 disclose downhole systems.

Despite work that has been done to develop systems for subsurface telemetry there remains a need for practical and reliable subsurface telemetry systems.

SUMMARY

This invention has a number of aspects. One aspect provides methods for transmitting data-carrying signals in a downhole environment. Another aspect provides a drill string constructed to facilitate data transmission along the drill string. Another aspect provides constructions for drill string components such as gap subs. Another aspect provides various constructions for providing local data communications among two or more downhole electronics packages. Another aspect provides methods and constructions for communicating data between sensors or other electronics located on or in a wall of a drillstring and electronics in a probe located within a bore of the drillstring. Another aspect provides methods and constructions for transmitting data across gaps provided for use in EM telemetry. A drillstring may be constructed to incorporate one or any combination of two or more of these aspects. There is synergy among different ones of these aspects. However, the aspects also have independent application.

One example aspect provides a downhole system comprising a plurality of electronics packages coupled to a drill string at locations spaced apart from one another along the drill string. Each of the plurality of electronics packages comprises an EM telemetry signal generator. The plurality of electronics packages includes at least first and second electronics packages. The first electronics package is configured to generate first EM signals by way of the corresponding EM telemetry signal generator at a first frequency or set of frequencies. The first EM signals encode first data. The first data may originate from sensors in or associated with the first electronics package and/or from other electronics packages. The second electronics package comprises an EM signal detector and is configured to receive the first EM signals. The second electronics package is further configured to generate second EM signals by way of the corresponding EM telemetry signal generator at a second frequency or set of frequencies different from the first frequency or set of frequencies. The second EM signals encode the first data.

Another non-limiting example aspect provides apparatus comprising a drillstring. the drillstring comprises a plurality of electrically-insulating gaps spaced apart along the drillstring. A plurality of EM telemetry signal generators are each coupled to apply an EM telemetry signal across a corresponding one of the plurality of gaps. A first one of the gaps has a first high first electrical impedance in a first frequency band, a first one of the EM telemetry signal generators of the plurality of EM signal generators is configured to transmit EM telemetry signals in the first frequency band and is coupled to apply the EM telemetry signals in the first frequency band across the first one of the gaps. The other ones of the plurality of gaps have electrical impedances in the first frequency band that are lower than the first electrical impedance.

Another non-limiting example aspect provides a gap sub assembly comprising a tubular body having a first coupling at an uphole end thereof, a second coupling at a downhole end thereof, and a bore extending between the first and second couplings. The body comprises an electrically conductive uphole portion; and an electrically conductive downhole portion separated by an electrically-insulating gap and an electrical high-pass or bandpass filter electrically connected across the gap.

Another non-limiting example aspect provides a gap sub assembly. The gap sub assembly comprises an electrically conductive uphole portion; and an electrically conductive downhole portion separated by a gap that provides a high electrical impedance in a lower frequency band and a lower electrical impedance in a higher frequency band. An EM telemetry signal generator is connected to apply a low frequency EM telemetry signal in the lower frequency band between the uphole portion and the downhole portion. A data signal generator is connected to drive a higher-frequency data signal across the gap, the data signal having frequencies higher than the EM telemetry signal in the higher frequency band at which the gap presents a reduced electrical impedance.

Further aspects of the invention and features of example embodiments are described in the following detailed description and/or illustrated in the accompanying drawings.

BRIEF DESCRIPTION OF THE FIGURES

The accompanying drawings illustrate non-limiting embodiments of the invention.

DETAILED DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
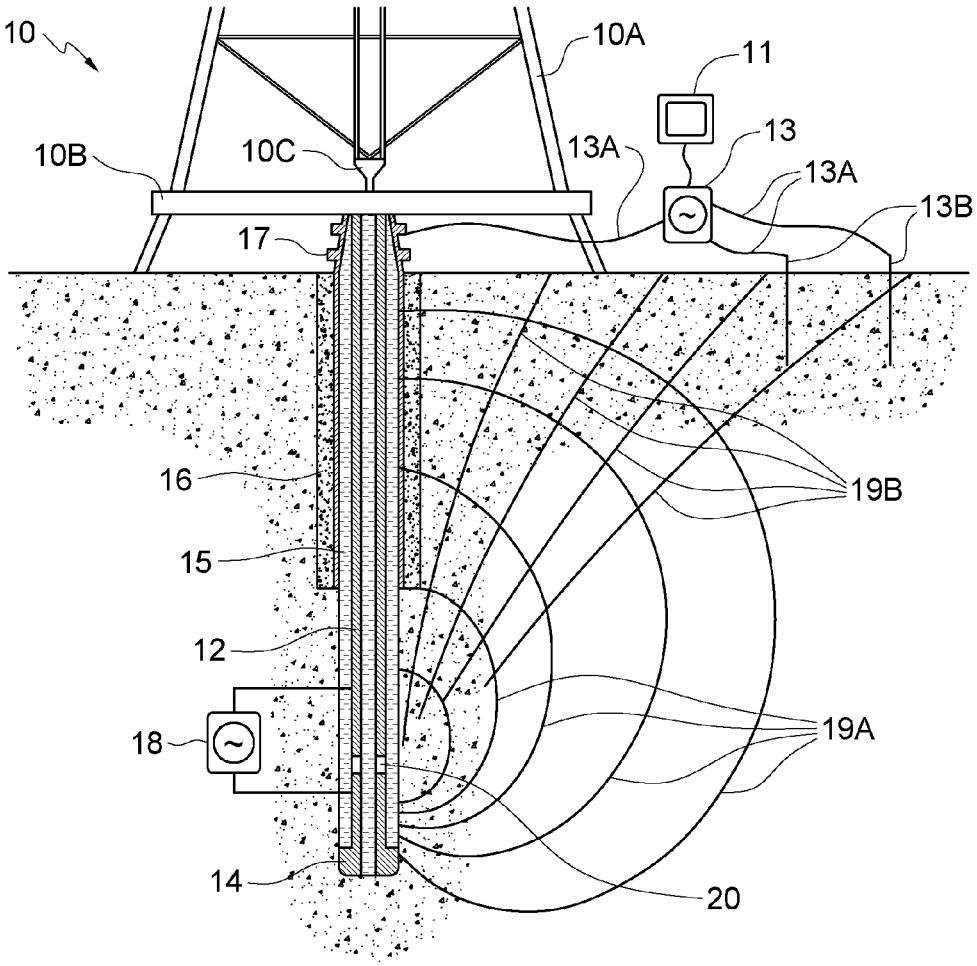
FIG. 1 is a schematic illustration showing a drilling site in which electromagnetic (EM) telemetry is being used for measurement while drilling.

FIG. 1 is a schematic representation of a drill site in which EM telemetry is being applied to transmit data to the surface. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid. The drilling fluid is pumped through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig Drill string 12 includes a gap sub assembly 20. The gap sub assembly 20 may be positioned, for example, at the top of the BHA. Ends of gap sub assembly 20 are electrically isolated from one another. The parts of the drill string above and below the gap sub each form one part of a dipole antenna structure. Gap sub assembly 20 may be coupled into drill string 12 in any suitable manner. In some embodiments gap sub assembly 20 has a male threaded coupling at one end and a female threaded coupling at the other end. The threaded couplings may, for example, be API threaded couplings.

An EM signal generator 18 is electrically connected across the electrically-insulating gap of gap sub assembly 20. EM Signal generator 18 may be located for example in an electronics probe contained within the bore of the drill string or within a wall of the drill string. EM Signal generator 18 may, for example, be located in one or more pockets, sheathed cavities, injected cavities, sealed ports and/or machined channels within drill string 12. EM telemetry signal generator 18 generates signals of a suitable frequency for EM telemetry. Such signals are typically low in frequency (typical EM telemetry signals for communication from downhole systems to surface equipment have frequencies in the range of tenths of Hz to 20 Hz). Various embodiments described herein involve communications between different downhole systems. For local communications between downhole systems frequencies higher than the frequencies usable for communication to surface equipment may be used (e.g. frequencies in the range up to several kHz). In some embodiments, frequencies used for local communications are in excess of 50 Hz or in excess of 100 Hz. Such local communications may, for example, include communications from electronics at or near a drill bit to electronics above a mud motor or communications between a series of electronics packages spaced apart along a part of the drill string.

Electrical signals applied across the gap by EM signal generator 18 result in low frequency alternating electrical currents 19A. The electrical signals from EM signal generator 18 are controlled in a timed/coded sequence to energize the earth in a manner that results in time-varying electric fields 19B that are detectable at the surface.

In the illustrated embodiment a signal receiver 13 is connected by signal cables 13A to measure potential differences between electrical grounding stakes 13B and the top end of drill string 12. A display 11 may be connected to decode the detected signals and to display data received by the signal receiver 13.

Any manner of data may be transmitted by EM telemetry. Examples of the types of data that may be transmitted include: sensor readings. A wide range of downhole sensors may be provided. The sensors may include, for example, vibration sensors, accelerometers, directional sensors, magnetic field sensors, acoustic sensors, well logging sensors, formation resistivity sensors, temperature sensors, nuclear particle detectors, gamma ray detectors, electrical sensors (e.g. sensors that measure currents and/or voltages in downhole equipment), flow meters, strain gauges, equipment status sensors, etc.

It may be desirable to provide downhole electronics that are not all housed in a common enclosure. For example, in some embodiments, EM signal generator 18 and/or one or more other telemetry systems may be housed in a probe within a bore of drill string 12. Electronics associated with certain sensors may be located outside of the probe, for example within a pocket in a wall of the drill string. This raises the issue of how to communicate data from the sensors to the probe for processing and/or transmission.

As another example case where it may be desirable to provide different electronics packages downhole, it may be desirable to provide electronics at or near to a drill bit 14 that communicate with other electronics uphole from a mud motor connected to drive the drill bit. As another example, it may be desirable to provide electronics at different elevations within a wellbore (for example uphole and downhole from a location at which the wellbore turns from being more vertical to being more horizontal).

Establishing data communication between separated downhole electronics is complicated by the extreme conditions of vibration, temperature, pressure, shocks typically encountered in the downhole environment. Another complication is that it would be desirable to provide a flexible communication system (i.e. a system that can accommodate communications to and from additional electronics packages with a minimum of re-design).

Figure 2:
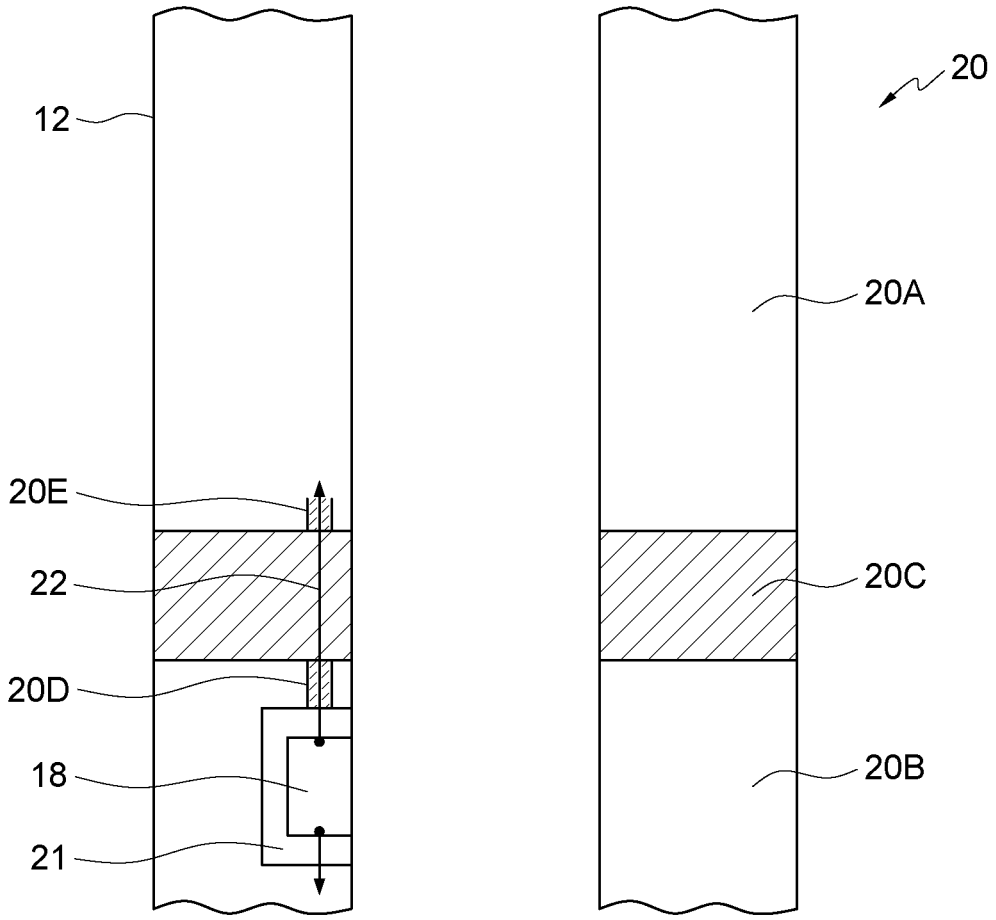
FIGS. 2, 2A and 2B are schematic longitudinal cross sectional views of gap sub assemblies according to example embodiments.

FIG. 2 shows an example gap sub assembly 20. Gap sub assembly 20 has an electrically-conducting uphole portion 20A and an electrically conducting downhole portion 20B separated by an electrically-insulating gap 20C. Gap 20C may be filled, for example, with an electrically-insulating material such as a suitable thermoplastic material.

In the example embodiment represented in FIG. 2, an EM signal generator 18 is located in a pocket 21 in a wall of a section of drill string 12 on one side of gap 20C. EM signal generator 18 is connected to apply a signal between uphole portion 20A and downhole portion 20B such that the signal causes a time varying potential difference across gap 20C. Since pocket 21 is made in downhole portion 20B, one output terminal of EM signal generator 18 may be electrically connected directly to downhole portion 20B.

A second output terminal of EM signal generator 18 is electrically connected to uphole portion 20A by means of an electrical conductor 22 that is electrically insulated from downhole portion 20B and passes through gap 20C to make electrical contact with uphole portion 20A. In the illustrated embodiment, the electrical conductor extends from pocket 21 through a passage 20D that extends longitudinally through downhole portion 20B.

In some embodiments, conductor 22 extends into a passage 20E in section 20A. When gap sub 20 is properly assembled, channels 20D and 20E are aligned with one another. A conductive wire or a plurality of electrically-insulated wires (not shown) may be fed through the aligned channels (20D, 20E) during manufacturing to span gap 20C of gap sub assembly 20. In some embodiments, external features (not shown) on uphole portion 20A and downhole portion 20B may be provided to indicate when channels 20D, 20E are properly aligned as gap sub 20 is being assembled. In some embodiments, uphole portion 20A and downhole portion 20B are coupled in part by pins or another coupling that maintains alignment of channels 20D, 20E as gap sub 20 is assembled.

Conductors passing through channels 20D, 20E of gap sub assembly 20 may be supported along their length and sheltered from extreme drilling conditions as they extend inside the walls of gap sub assembly 20.

Figure 2A:
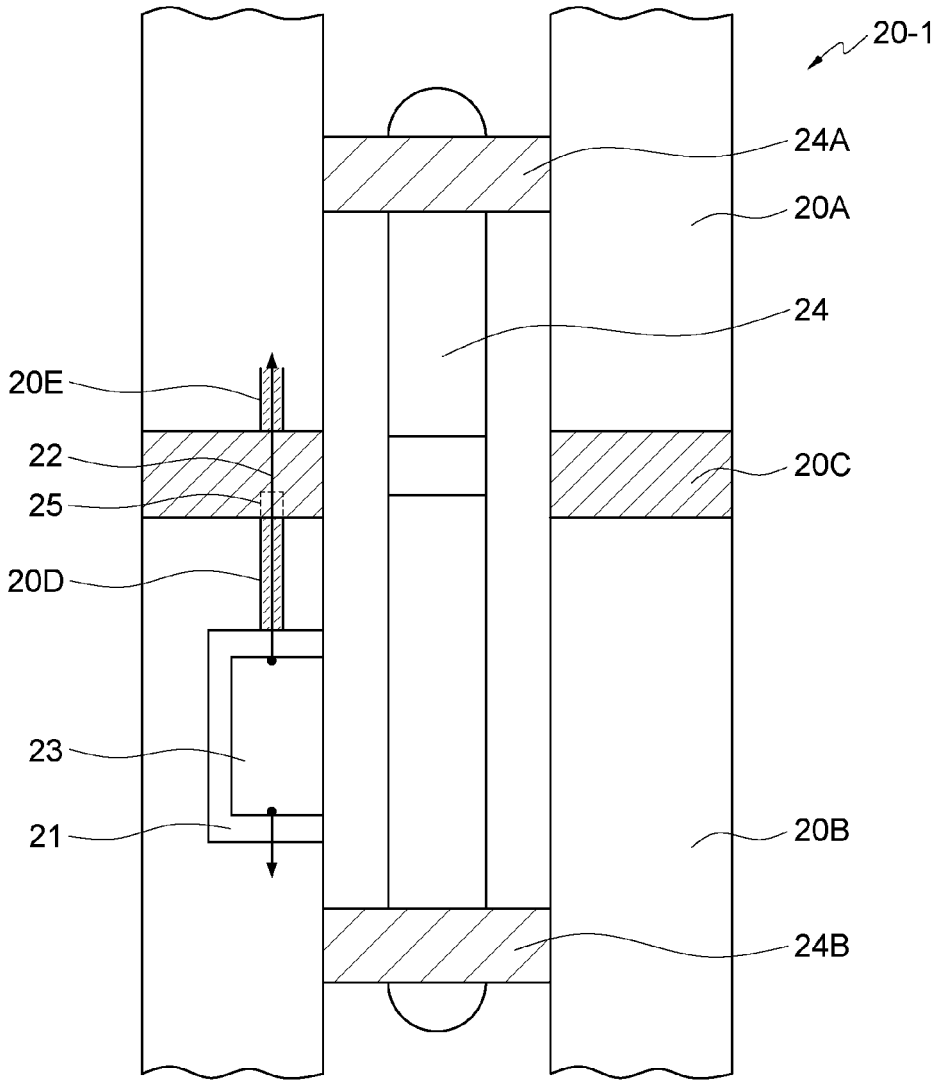

FIG. 2A shows a gap sub assembly 20-1 according to another example embodiment in which electronics 23 in pocket 21 can communicate across gap 20C. In FIG. 2A an optional downhole probe 24 is shown located inside the bore of gap sub assembly 20-1. Probe 24 is in electrical communication with uphole portion 20A and downhole portion 20B by way of electrical conductors 24A and 24B. Electronics 23 in pocket 21 is connected to apply and/or detect electrical signals across gap 20C. Electronics in probe 24 may also be connected across gap 20C by way of electrical conductors 24A and 24B.

Electronics 23 has a terminal connected to uphole portion 20A as described above and another terminal connected to downhole portion 20B as described above. Consequently, electronics 23 can communicate to/from probe 24 by any of (depending on the configuration of electronics 21): applying a time-varying potential difference across gap 20C; detecting a time-varying potential difference applied across gap 20C by probe 24; modulating a current supplied by probe 24; monitoring modulation of a current by probe 24.

In the embodiment illustrated in FIG. 2A, an EM telemetry signal generator may be provided in either or both of probe 24 and electronics 23. In an example embodiment, the EM telemetry signal generator is provided in probe 24 and one or more sensors are provided in electronics 23. Electronics 23 signals readings from the one or more sensors to probe 24 as described above and probe 24 then transmits the readings or information derived using the readings to the surface.

It is not mandatory in all embodiments that conductor 22 provides a direct electrical contact between electronics in pocket 21 and uphole portion 20A. In some embodiments, signals from electronics in pocket 21 are coupled to uphole portion 20A by way of an electrical filter 25. Filter 25 may pass signals in certain frequency bands and block signals in other frequency bands. For example, in some embodiments (e.g. where EM signal generator 18 is located in probe 24) filter 25 may comprise a high-pass filter or a band-pass filter that blocks the very low frequencies typically used in EM telemetry and passes higher-frequency signals. In some embodiments signals from electronics package 21 are transferred across gap 20C by way of an inductive coupling between coils or the like. The coils may be located on either side of gap 20C and/or embedded in a dielectric material that electrically separates uphole and downhole portions 20A and 20B. Electrical properties of the coils (e.g. inductance) may be selected to achieve desired filter characteristic for transmission across gap 20C.

Figure 2B:
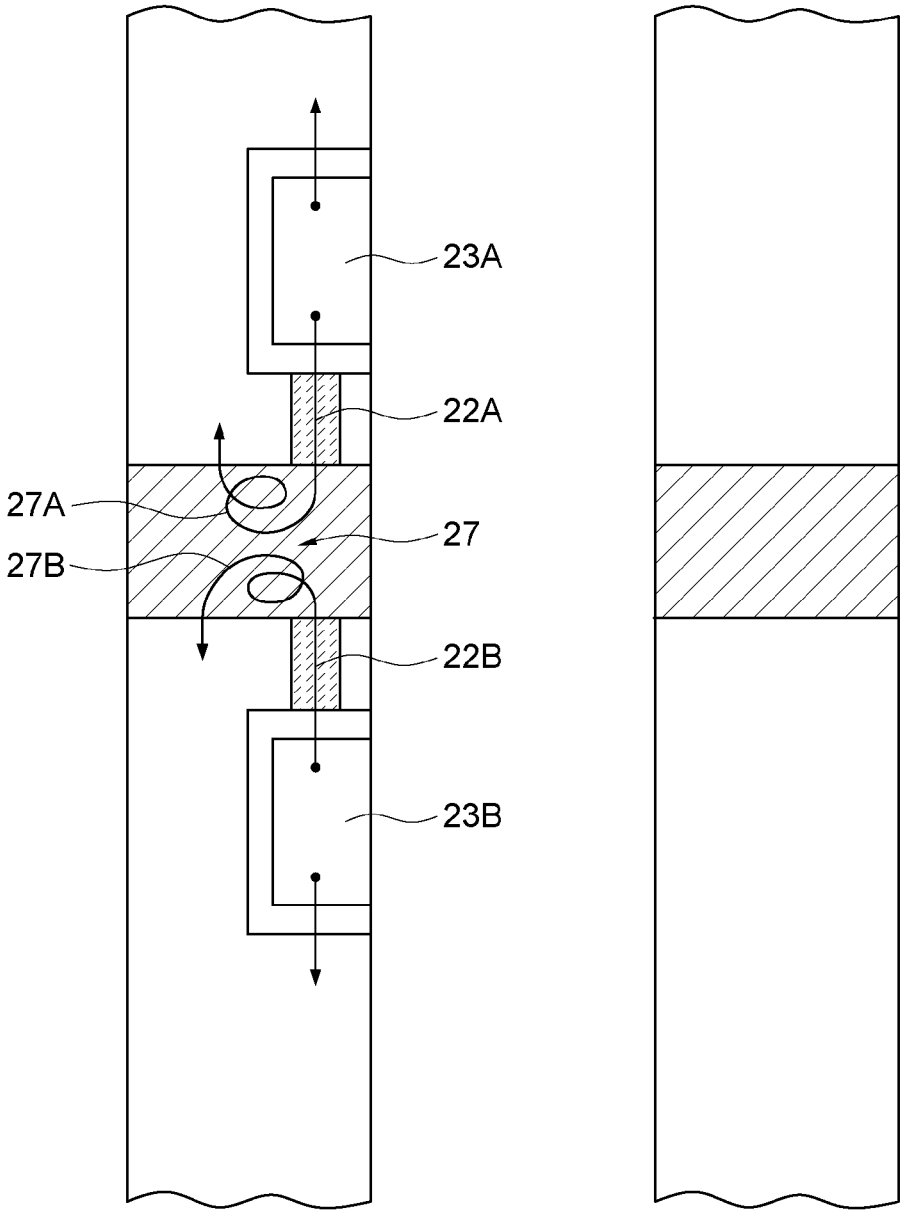

FIG. 2B illustrates an example embodiment signal transmission across gap 20C between electronics packages 23A and 23B facilitated by an inductive coupling 27 between coils 27A and 27B. Coil 27A is connected between an uphole conductor 22A and the uphole portion 20A. Coil 27B is connected between a downhole conductor 22B and the downhole portion 20B.

Figure 3A:
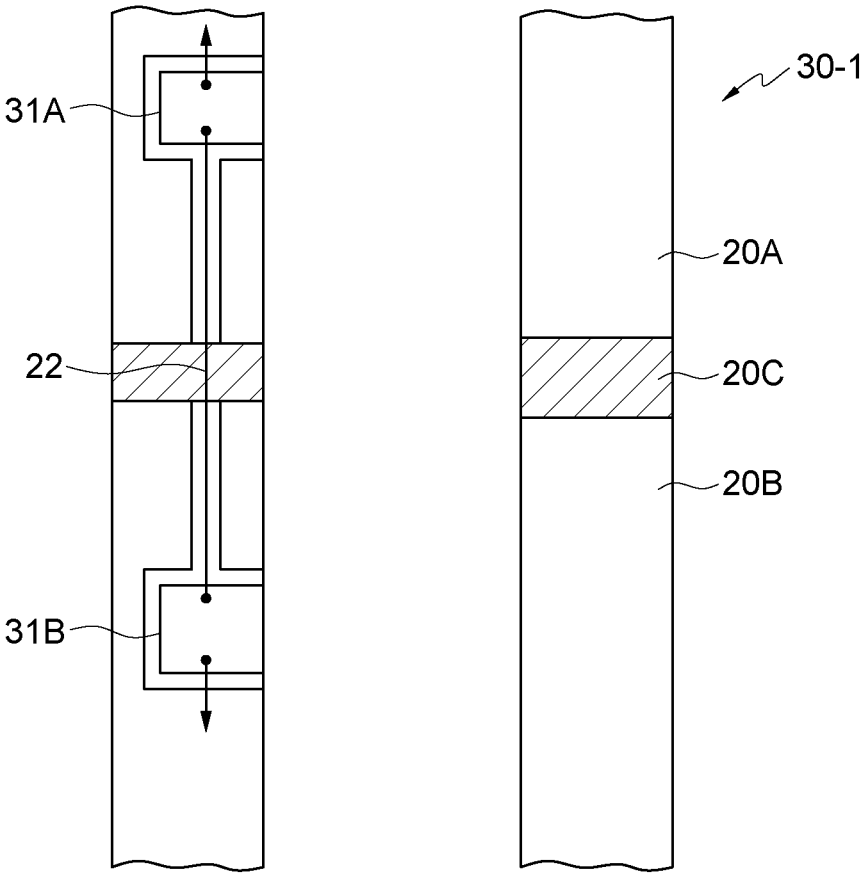
FIGS. 3A, 3B and 3C are schematic longitudinal cross sectional views of gap sub assemblies according to alternative example embodiments.
Figure 3B:
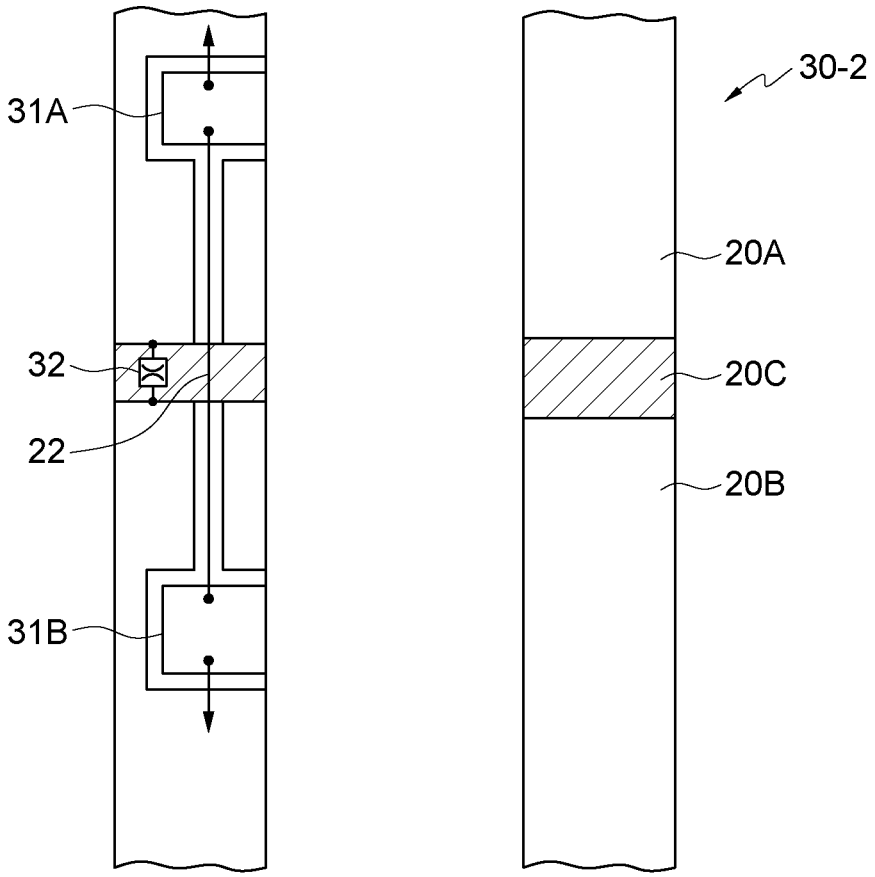
Figure 3C:
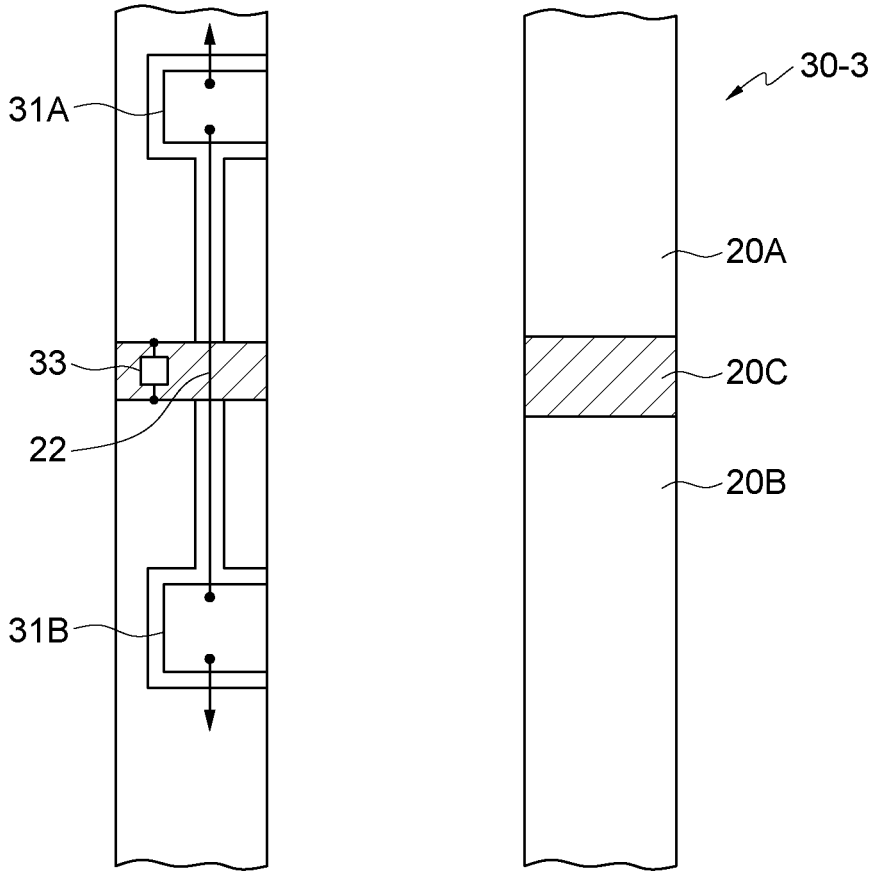

FIGS. 3A, 3B and 3C respectively show gap sub assemblies 30-1, 30-2 and 30-3 according other embodiments. In these Figures, data is communicated across gap 20C. In each of these gap sub assemblies, electronics 31A and 31B are respectively provided on uphole and downhole sides of gap 20C. Electronics 31A and 31B each have a terminal electrically connected to an electrical conductor 22 that is electrically insulated from uphole and downhole portions 20A and 20B and passes through gap 20C. Electrical conductor 22 may, for example, extend through longitudinally extending passages in uphole portion 20A and downhole portion 20B. The passages may be aligned with one another so that electrical conductor 22 can extend directly across gap 20C in a longitudinal direction.

Electronics 31A and 31B may be located in any suitable cavities within portions 20A and 20B respectively. The cavities may, for example comprise pockets opening to the inside or outside of portions 20A and 20B, cavities formed inside portions 20A and 20B, sealed ports, machined channels or the like. The cavities may be sealed against the ingress of pressurized fluid and/or filled with a suitable potting compound to exclude pressurized fluid and/or the electronics may be contained in the cavities within a housing suitable for protecting the contained electronics from the downhole environment.

FIGS. 3A, 3B and 3C differ as to the mechanism by which data is transmitted across gap 20C. In FIG. 3A, second terminals of electronics 31A and 31B are respectively connected to uphole and downhole portions 20A, 20B. Data is transmitted across gap 20C by way of the capacitance of gap 20C.

Since gap 20C provides two electrical conductors (uphole and downhole portions 20A and 20B separated by a dielectric material (gap 20C), Gap 20C functions as a capacitor. The capacitance of gap 20C is determined principally by the areas of the facing parts of portions 20A and 20B, the thickness of the dielectric material between the facing parts of portions 20A and 20B and the dielectric constant of the material in the gap.

Capacitance of a parallel-plate capacitor is given by the following equation:

$$C = \varepsilon_r \varepsilon_0 \frac{A}{d} \tag{1}$$

Where: C is the capacitance; A is the area of overlap of the two plates; $\in_r$ is the dielectric constant of the material between the plates; $\in_0$ is the electric_constant ($\in_0 \approx 8.854 \times 10^{-12}$ F $m^{-1}$); and d is the separation between the plates. While the capacitance of gap 20C will differ from that given by Equation 1 because of geometrical factors, Equation 1 illustrates that capacitance of gap 20C increases with increased area and increased dielectric constant $\in_r$ and decreases for increased spacing between the conductive parts.

A capacitor will block direct currents but will pass alternating currents. The current that will flow through a capacitor will depend on the capacitive reactance which is, in turn dependent on the frequency of the applied signal. The capacitive reactance of a capacitor may be calculated using the following equation:

$$Xc = \frac{1}{2\pi f C} \tag{2}$$

Where: Xc=capacitive reactance in Ohms, $\pi$=3.142 or 22/7; f=frequency of the alternating current in Hertz, and C=capacitance in Farads.

Figure 4:
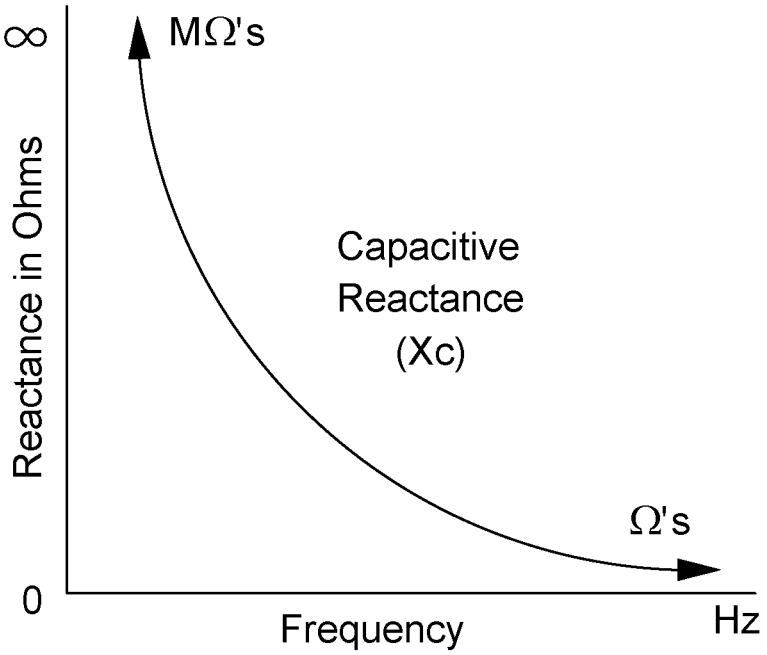
FIG. 4 is a plot showing the behaviour of capacitive reactance of a capacitor as a function of frequency.

Therefore, as can be seen in FIG. 4, as the frequency of the alternating current applied across a capacitor is increased, the capacitive reactance is reduced. For high enough frequencies signals from electronics 31A applied to uphole portion 20A can be transmitted directly across gap 20C to be received by electronics 31B in downhole portion 20B. Conductor 22 provides a return path. At the same time, low frequency telemetry signals applied across gap 20C are not conducted across gap 20C. Telemetry signals may be applied, for example, by a probe 24 (not shown in FIG. 3A). The capacitance of gap 20C may be increased by adopting a construction in which the surface areas of adjacent parts of portions 20A and 20B are increased (e.g providing interdigitating fins on portions 20A and 20B), decreasing the space between the adjacent parts of portions 20A and 20B, and/or using as an insulating material a material that has a high dielectric constant.

When the alternating current frequency is very high, the capacitive reactance of the gap sub assembly becomes negligible. Under these conditions, the gap sub may act essentially as a wire directly conducting signals between uphole and downhole portions 20A and 20B.

Gap sub assembly 30-2 of FIG. 3B is similar to gap sub assembly 30-1 except that a capacitor 32 is electrically connected across gap 20C. As capacitor 32 is electrically in parallel with gap 20C the capacitance across gap 20C is increased (thus, lowering capacitive reactance for a given signal frequency). Capacitor 32 may be located for example in gap 20C (e.g. embedded in dielectric material of gap 20C or in a probe 24 that spans gap 20C or in a sleeve within the bore of gap sub assembly 30-1, or in a pocket located in drillstring 12 near to gap 20C).

Gap sub assembly 30-3 of FIG. 3C is similar to gap sub assembly 30-1 except that a filter 33 is electrically connected across gap 20C. Filter 33 may comprise, for example, a high-pass filter, a bandpass filter, a notch filter, a band-stop filter, an inductive coupling or the like. The signals transmitted between electronics 31A and 31B are selected to have frequencies passed by filter 33. Again, conductor 22 provides a return path.

The principles discussed above may also be applied in the case where there are two or more (a plurality) of gaps in a drill string or where there are multiple (three or more) gaps in the drill string. In such cases signals may be transmitted along the drill string between electronics that are separated by two or more gaps. In some embodiments different gaps are configured to allow transmissions of signals within different frequency bands such that certain signals may be available to electronics in some portions of the drill string and not available to electronics in other portions of the drill string.

Figure 5:
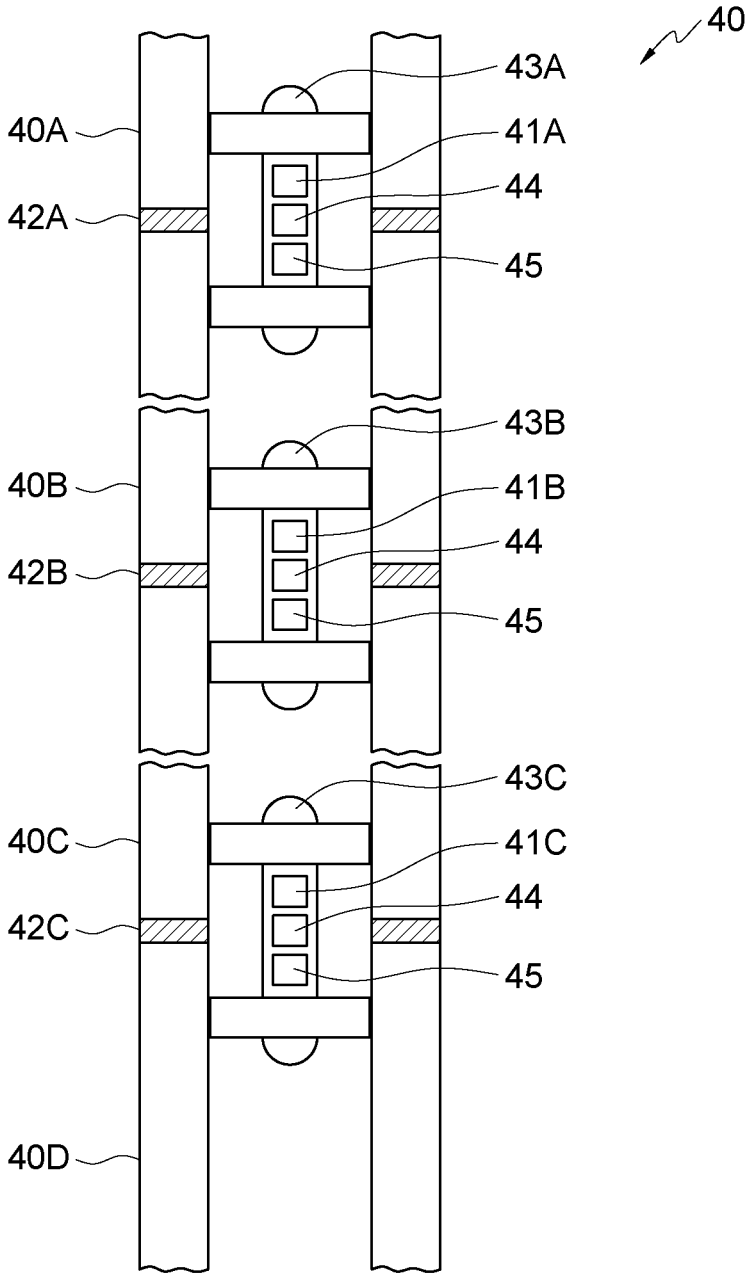
FIGS. 5, 5A and 5B are schematic illustrations showing a section of a drill string having gaps and electronics packages that can communicate by applying signals across the gaps.

FIG. 5 shows part of a drill string 40 that has longitudinally-separated portions 40A, 40B, 40C, 40D separated by gaps 42A, 42B, and 42C (generally and collectively gaps 42). Electronics packages 41A, 41B, and 41C (generally and collectively electronics packages 41) are respectively located in probes 43A, 43B and 43C (generally and collectively probes 43) that span gaps 42A, 42B, and 42C respectively.

Some or all of electronics packages 41 comprise a receiver 44 (e.g. a circuit connected to monitor a potential difference across the corresponding gap 42). Some or all of electronics packages 41 also include a signal generator 45 connected to apply electrical signals across the corresponding gap 42.

In an example embodiment, gap 42A exhibits a high-pass filter characteristic and gaps 42B and 42C exhibit low-pass filter characteristics. In this embodiment, if electronics package 41A imposes a low frequency EM telemetry signal across gap 42A then that signal will propagate uphole and downhole from gap 42A. Since gap 42A has a high-pass filter characteristic, gap 42A appears as an insulator to the low frequency EM telemetry signal. Where the low-frequency telemetry signal is within the passbands of gaps 42B and 42C, gaps 42B and 42C allow the signal to pass, thereby allowing detection of the EM telemetry signal at the surface. Similarly, electronics package 41A can receive low-frequency EM downlink signals transmitted from the surface.

Gaps 42B and 42C have filter characteristics that offer increased impedance to signals of frequencies $f_B$ and $f_C$ that are passed by the other one of gaps 42B and 42C and are blocked by gap 42A. This permits electronics 41B and 41C to detect signals of the corresponding frequency by monitoring the potential across the corresponding gap 42B and 42C. For example, if electronics package 41A imposes a signal at frequency $f_B$ across gap 42A, a potential difference at frequency $f_B$ will be detectable at gap 42B since the signal is passed by gap 42C (gap 42C presents low impedance to the signal). Similarly, if electronics package 41A imposes a signal at frequency $f_C$ across gap 42A, a potential difference at frequency $f_C$ will be detectable at gap 42C since the signal is passed by gap 42B.

Frequencies $f_B$ and $f_C$ may be high enough that they are significantly attenuated by propagation through the earth. Such frequencies may be outside of the range that is usually used for EM telemetry (e.g. such frequencies may be well over 20 Hz). However, since gaps 42B and 42C may be relatively close to gap 42A as compared to the distance between gap 42A and the surface the receivers 44 of gaps 42B and 42C may detect signals at frequencies $f_B$ and $f_C$ respectively notwithstanding that frequencies $f_B$ and $f_C$ may be too high for effective EM telemetry to the surface.

Figure 5A:
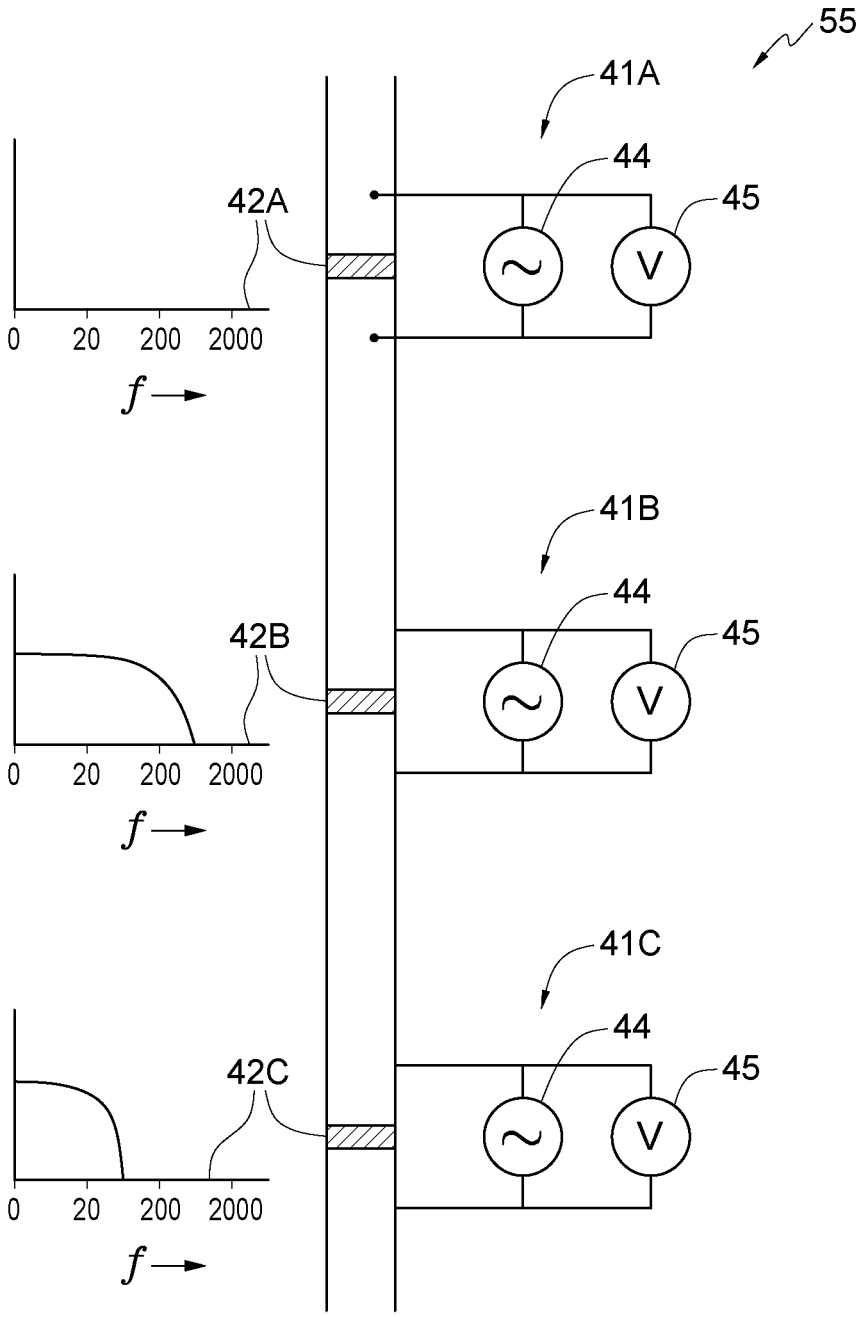

In general, where there are N gaps in a drillstring, each having an electronics package that can impose electrical signals across the gap and detect electrical potentials across the gap communication may be established between any pair of the electronics package by selecting a communications frequency at which both of the pair of gaps offers a high impedance and the other gaps provide a low impedance. FIG. 5A shows a portion of a drill string 55 according to an example embodiment in which there are three gaps 42. Gap 42A has a high-pass filter characteristic (e.g. a characteristic that offers high impedance at all frequencies below 20 kHz). Gap 42B has a low-pass filter characteristic. Gap 42C has a band-stop (low-pass and high pass) filter characteristic. In an example case, electronics package 41A can communicate with the surface by EM telemetry in a frequency band of 0.1 to 20 Hz, with electronics package 41B at a frequency of 2000 Hz and with electronics package 41C at a frequency of 200 Hz.

It can be seen that the filter characteristics of gaps 42B and 42C pass signals in the low-frequency 0.1 to 20 Hz band and therefore do not interfere with EM telemetry between electronics package 41A and the surface. Gap 42C passes the 2000 Hz signal that is blocked by gaps 42A and 42B. Gap 42B passes the 200 Hz signal that is blocked by both gaps 42A and 42C. While three gaps 42 are illustrated in FIG. 5, the same principles may be applied to cases in which there are two or more gaps. Any reasonable number of gaps may be provided.

Advantageously, higher frequencies are used for shorter distance communication and lower frequencies are used for longer-distance communication. For example, telemetry to/from the surface may be performed using very low-frequency signals (e.g. in the band below 25 Hz). Telemetry between two more-widely separated electronics packages in a drill string may be performed at medium frequencies (e.g. a few hundred Hz, e.g. the band of 100 Hz to 600 Hz). Telemetry between two more-closely spaced electronics packages in the drillstring may be performed at a higher frequency (e.g. a few kHz, for example frequencies in the band of 1000 Hz to 6000 Hz).

In some embodiments, different frequency bands are well separated (e.g. differ in frequency by a factor of at least 5, at least 8 or at least 10). Such embodiments may use filters that have low slopes (i.e. filters for which the impedance changes relatively slowly with frequency). In some embodiments the filters comprise first order filters. In some embodiments the filters have a rolloff of approximately 20 db/decade or less.

In some embodiments, gap 42A is above a mud-motor that is near a lower end of the drillstring and gap 42B is between the mud motor and a drill bit. A third gap may or may not be present in such embodiments. In some embodiments gap 42B is within 1 meter of the drill bit. [0068] As described above, the filter characteristics of a gap may be provided by one or more of: electronic properties resulting from the construction of the gap and/or electronic components connected across the gap (either directly or in a probe or other structure connected across the gap).

Figure 5B:
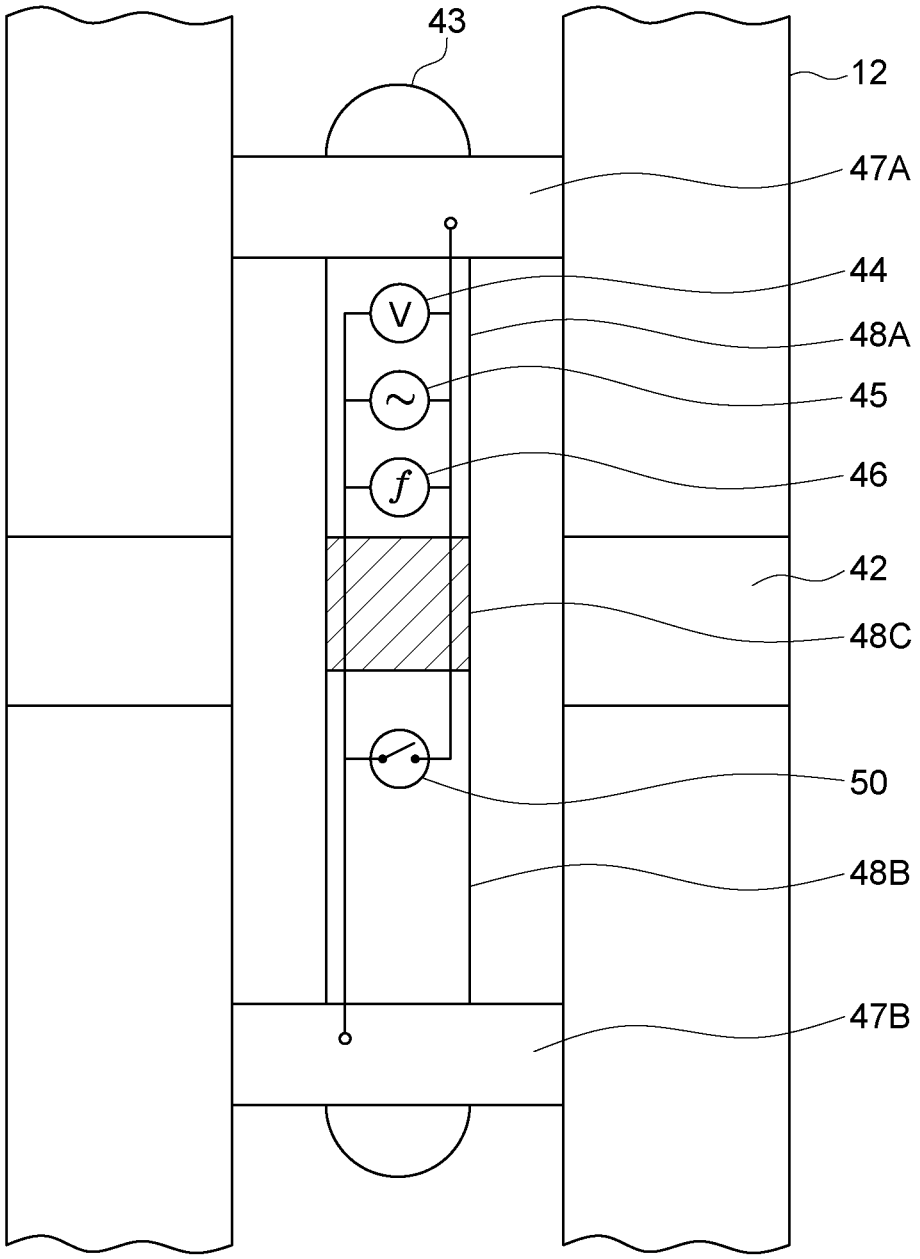

FIG. 5B shows a probe 43 connected to span a gap 42 in a drillstring 12. Probe 43 includes a signal receiver 44, a signal generator 45 and a filter 46 all connected between contacts 47A and 47B that contact drillstring 12 above and below gap 42. In the illustrated embodiment, probe 43 includes an electrically-conductive housing 48 having parts 48A and 48B separated by an electrically-insulating gap 48C.

Some embodiments provide an electrically-controlled switch 50 that can be closed to provide a short circuit across gap 42. Such a switch may be provided in a probe, for example. Such switches may be closed at certain times to provide improved conduction across gap 42 for signals that must pass across gap 42. In an example embodiment in which probes 43A, 43B, and 43C of FIG. 5 are like probe 43 of FIG. 5A, electronics package 41A has data to transmit to the surface by EM telemetry. Electronics package 41A may signal to electronics packages 41B and 41C to close switches 50 for a period of time sufficient to transmit some data. Electronics packages 41B and 41C may then operate switches 50 to short out gaps 42B and 42C thereby facilitating transmission of data to and/or from the surface by electronics package 41A. After the end of the period, electronics packages 41B and 41C may open switches 50 so that electronics packages 42B and 42C can again transmit and/or receive signals.

In some embodiments, switches 50 are controlled based on the frequencies of detected signals. For example, some electronics packages 41 may comprise signal detectors connected to detect a signal across a corresponding gap 42. In response to detecting a signal in a predetermined frequency range the electronics package may be configured to automatically close switch 50 for a given period of time. In an example embodiment, one or more electronics packages 41 may be configured to close a switch 50 on detecting a low-frequency signal (e.g. a signal of less than 25 Hz).

In some embodiments, electronics packages 41A, 41B and/or 41C comprise transmitters and/or receivers for an additional telemetry type (e.g. mud pulse telemetry). In such embodiments commands for setting switches 50 may optionally be transmitted by way of the other telemetry system (e.g. mud pulse telemetry).

In some embodiments a plurality of electronics packages 41 may all communicate on the same frequency band. In such embodiments each of gaps 42 may comprise a filter that provides enough impedance to develop a detectable potential difference across the gap when a signal in the frequency band is transmitted by another one of the electronics packages (but not so much impedance that the signal is rendered undetectable at other ones of gaps 42).

In some embodiments, one electronics package 41 may serve as a master and other electronics packages may serve as slaves. In such master-slave embodiments the slaves may transmit information on one or more frequencies in response to commands received from the master. For example, the master may send a request to a slave for the latest information set from the slave. The slave may respond by transmitting data including the requested information set. The information set may, for example, include output values recorded for one or more sensors at the slave.

In some embodiments, the master corresponds to an electronics package 41 that maintains telemetry with the surface and one or more of the slaves corresponds to an electronics package that includes one or more sensors. In such embodiments, the slaves may be configured to, on request, transmit to the master data collected from the sensors and the master may be configured to transmit to the surface data received from the slaves.

Figure 6:
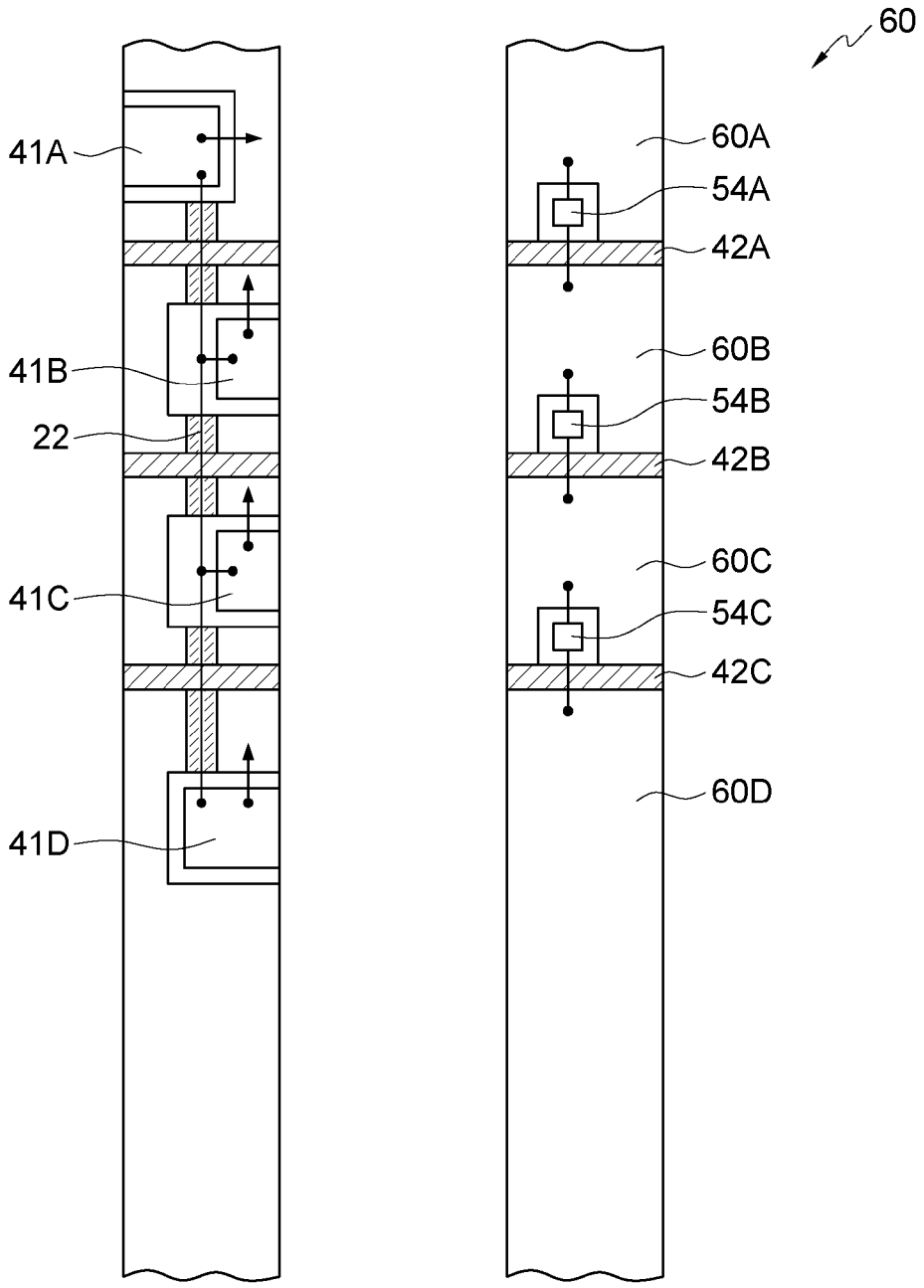
FIGS. 6, 6A, 7 and 7A are schematic longitudinal cross sectional views of parts of example drill strings which include gaps according to example embodiments.

FIG. 6 shows part of a drill string 60 that has longitudinally-separated portions 60A, 60B, 60C, 60D separated by gaps 42A, 42B, and 42C. Electronics packages 41A, 41B, 41C and 41D (generally and collectively electronics packages 41) are respectively located in portions 60A, 60B, 60C, and 60D. Other electronics packages may be located in probes within a bore of the drillstring. Each probe may span one or more of gaps 42 (in some embodiments a probe spans one gap 42 in the sense that the probe is in direct electrical contact with conductive parts of the drill string on either side of the gap 42). Although only one electronics package is shown as being in each drill string portion there could be more than one electronics packages in some or all of the drill sting portions.

In the example embodiment shown in FIG. 6, a plurality of electronics packages 41 that are located in pockets in drillstring 60 are interconnected by a conductor 22 which is electrically insulated from drill string portions 60A, 60B, 60C, 60D. Electronics packages 41 each also have a terminal in electrical contact with the corresponding drill string portion 60A, 60B, 60C, or 60D. In this way, each electronics package 41 can apply a signal between conductor 22 and the corresponding portion of the drill string and/or detect signals by monitoring the potential difference between conductor 22 and the corresponding portion of the drill string.

A system as shown in FIG. 6 can be versatile as it can permit one- or two-way communication between any pair of electronics packages 41 that are connected to conductor 22 and only requires a single conductor 22 connecting the electronics packages. In some embodiments the single conductor may comprise a power wire that delivers electrical power to the electronics packages 41 from a source of electrical power such as a battery pack, downhole generator or the like. Conductor 22 may extend across zero, one or more gaps 42. Any number of additional electronics packages may be added. Different electronics packages may comprise different sensors and/or processors and/or data stores and/or control circuits for controlling downhole equipment and/or interface circuits for interfacing to downhole equipment. In some embodiments conductor 22 extends along all or a part of a BHA.

FIG. 6 shows optional filters MA, MB and MC that are respectively electrically connected across gaps 42A, 42B, and 42C. In some embodiments filters MA, MB and MC have different characteristics such that at least one of filters 54 will pass some signals that are not passed by at least another one of filters 54. This construction is one way to limit propagation of certain signals to only certain portions of drill string 60.

In some embodiments, some or all of filters 54 have multiple pass bands. For example, all of filters 54 may have a common passband. Signals having frequencies within this common passband may be transmitted between any pair of electronics packages 41 that have connections to conductor 22. Each filter 54 may also have one or more uncommon passbands that are not shared by all filters 54. Signals having frequencies within such uncommon passbands will be blocked at gaps where the filter does not pass frequencies of the uncommon passband.

Conductor 22 may also permit EM telemetry signals to be applied between any different sets of portions 60A, 60B, 60C, 60D. For example, an EM signal generator in one of electronics packages 41 may apply an EM telemetry signal between conductor 22 and the portion in which the electronics package 41 is located. Switches in one or more other electronics packages may be closed to connect conductor 22 with one or more other ones of the portions. The applied EM signal may generate electrical currents 19A and electric fields 19B that may be detected at the surface.

Figure 6A:
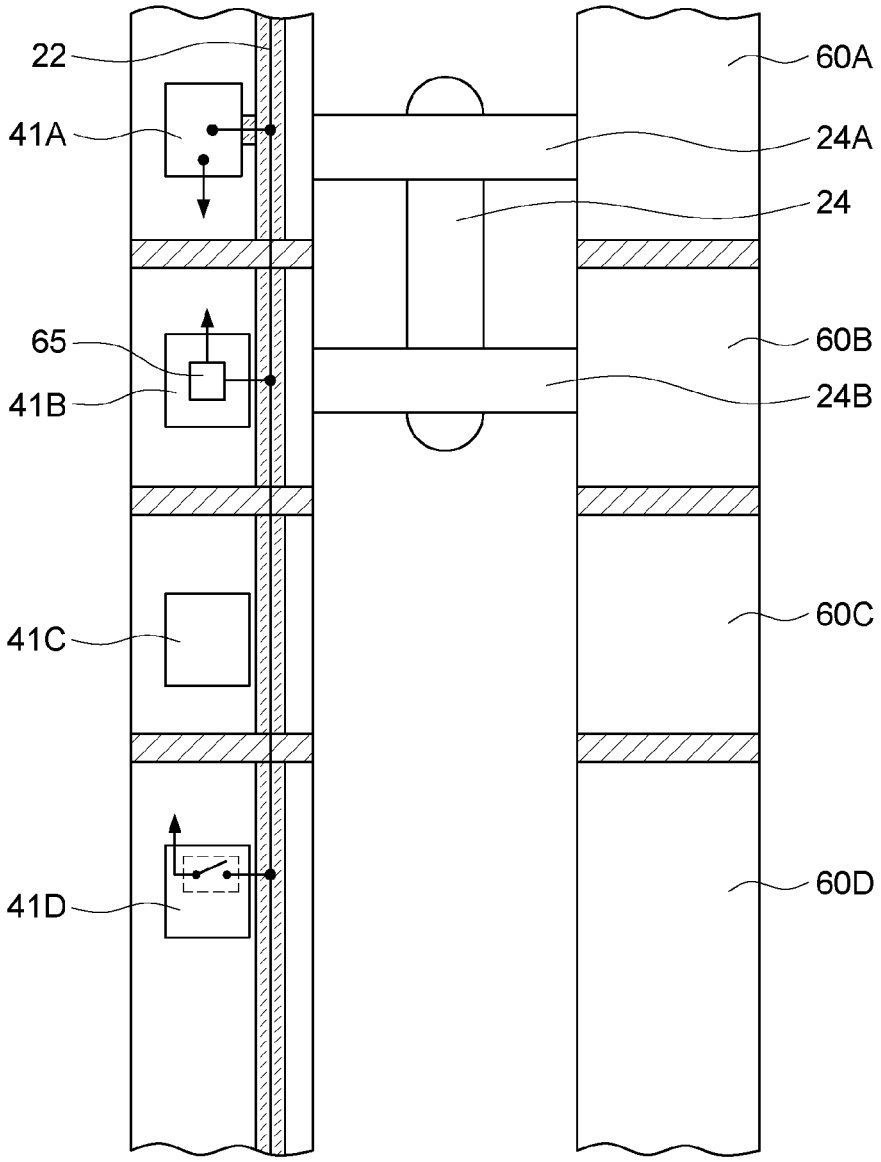

Although not shown in FIG. 6, a probe 24 as described above may optionally be located in the bore of drill string 60 in electrical contact with any pair of portions 60A, 60B, 60C and 60D. In some embodiments, one or more electronics packages 41 are configured to generate signals directed to probe 24. For example, FIG. 6A shows a way that electronics package 41A may direct signals to a probe 24 that has electrical contacts connected electrically to portions 60A and 60B. Electronics package 41A applies the signal between portion 60A and conductor 22. A switch or filter 65 in electronics package 41B passes the signal from conductor 22 to portion 60B. The signal is thereby applied across the contacts 24A and 24B of probe 24. Electronics within probe 24 may detect the signal.

A number of variations are possible in the practice of this invention. While some embodiments have been described as having a component such as an electronics package either downhole or uphole of another feature such as a gap, other embodiments may have the same or a similar component moved to be uphole or downhole (on the other side) of the other feature instead. While the above embodiments use a single conductor 22 to connect various electronics packages, other embodiments may have two or more conductors 22 crossing one or more gaps. Conductors 22 are not necessarily continuous (capable of carrying DC electrical currents along their lengths). In some embodiments, conductors 22 have capacitors and/or filters connected in series with different sections of the conductors.

Figure 7:
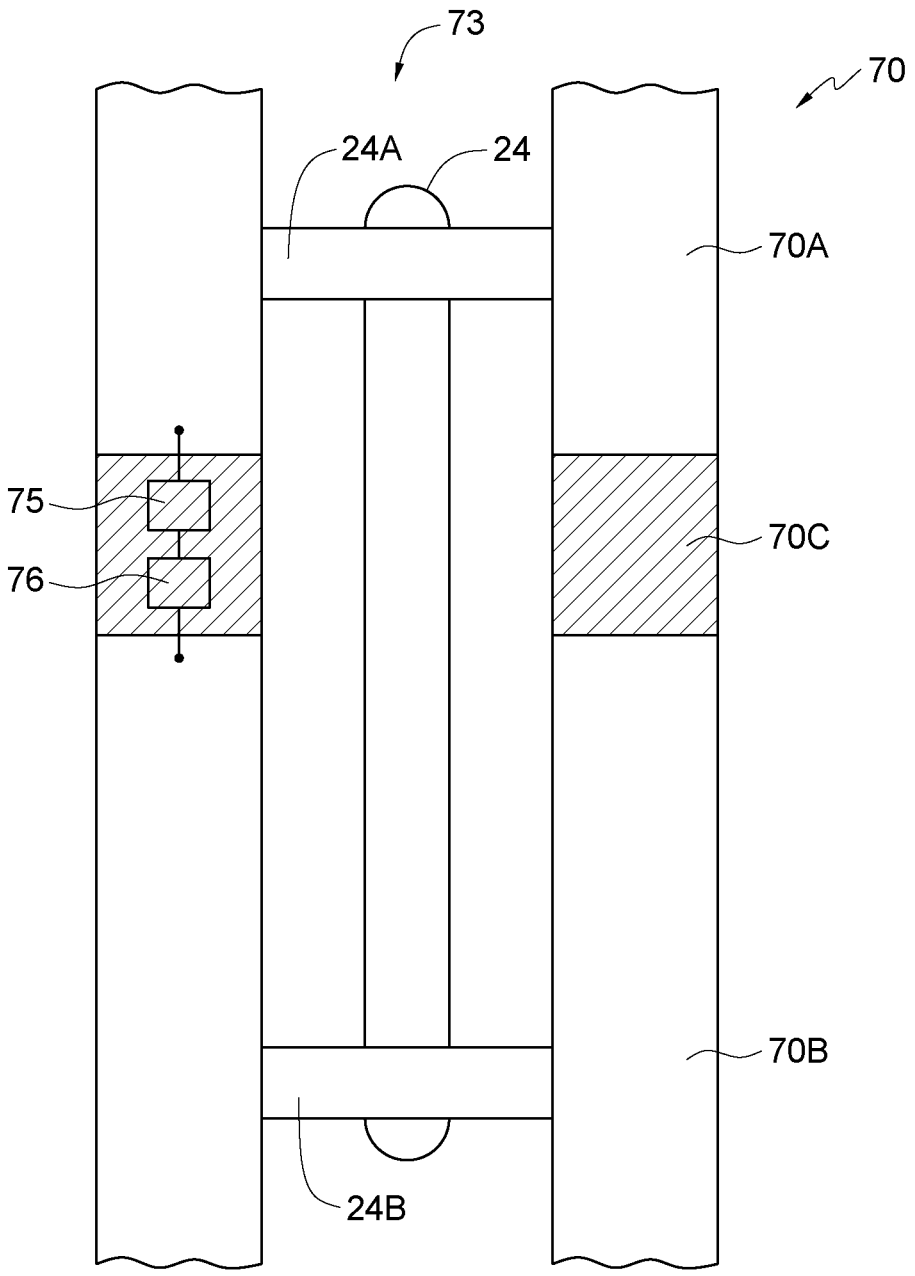

FIG. 7 shows a drill string 70 according to another example embodiment in which a signal is propagated through a gap. A probe 24 in a bore 73 of drill string 70 connects between an uphole portion 70A and a downhole portion 70B separated by a gap 70C. Probe 24 can apply low-frequency EM telemetry signals across gap 70C. Gap 70C acts as an electrical insulator (i.e. presents a high electrical impedance) to those signals.

Probe 24 can also apply higher-frequency signals between uphole and downhole portions 70A and 70B. Such higher-frequency signals can bypass gap 70C by a path that includes a sensor or other electronics. In the illustrated embodiment a sensor circuit 75 is connected in series with a filter 76 between uphole portion 70A and downhole portion 70B. Filter 76 blocks low-frequency EM telemetry signals. Probe 24 can interrogate one or more sensors in sensor circuit 75 by applying a high-frequency signal between uphole portion 70A and downhole portion 70B.

The frequency of the high-frequency signal is selected to be passed by filter 76. Sensor circuit 75 is configured to modulate the high-frequency signal in a manner that encodes readings of the sensor. The data signal may be applied continuously, periodically or intermittently depending on the situation. While sensor circuit 75 and filter 76 are illustrated as being separate, the functions of supporting a sensor and providing filtering to allow passage of the data signal (while presenting a high impedance to low frequency EM telemetry signals) may be integrated together in one circuit.

Encoding of the data signal may be simple (e.g. altering an impedance presented to the data signal in relation to the sensor reading) or more complicated (e.g. varying the signal current flowing through sensor circuit 75 so as to encode digital data in the current variations). Sensor circuit 75 may optionally be powered by electrical power provided by the signal. In another embodiment, sensor circuit 75 is powered by establishing a DC potential difference across gap 70C. For example, a battery pack in probe 24 may be configured to apply a DC voltage between electrical contacts 24A and 24B. Other electronics packages having connections to both sides of the gap may be powered by drawing current from the battery pack in probe 24.

The sensor in sensor circuit 75 may be of any suitable type. For example, the sensor may comprise a gamma radiation sensor.

Drill string 70 may be modified with the addition of one or more additional gaps between uphole portion 70A and downhole portion 70B. By selecting a signal frequency that corresponds to a passband of the additional gaps, probe 24 can interrogate sensor circuit 75 The signal propagates through the additional gaps.

Figure 7A:
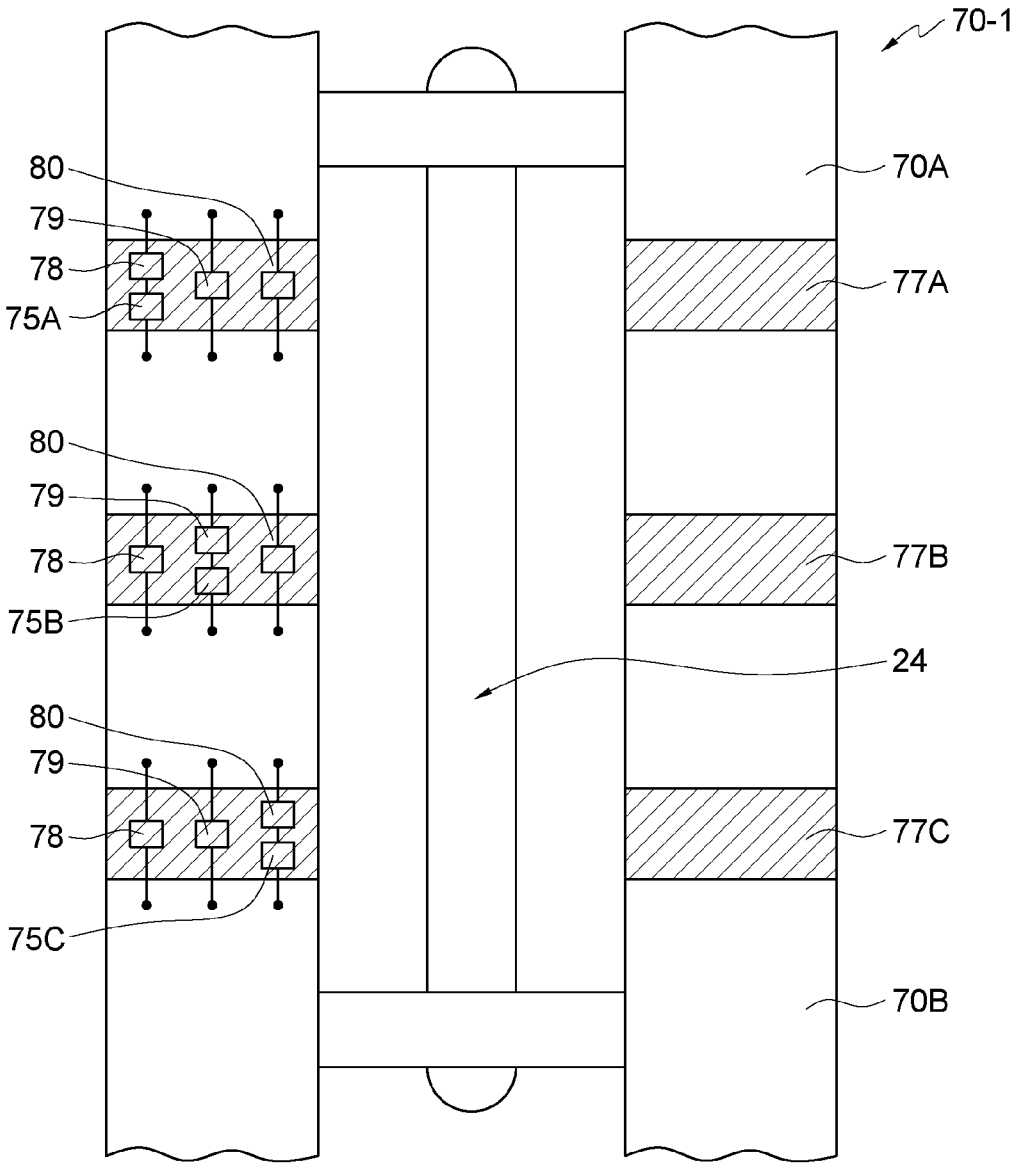

FIG. 7A shows a portion of a drill string 70-1 that is similar to drill string 70 but includes three gaps 77A, 77B and 77C between uphole portion 70A and downhole portion 70B. Three filters 78, 79 and 80 are connected across each gap. Filters 78, 79 and 80 have passbands that are different from one another. Each gap has filters 78, 79 and 80 providing the same set of passbands. A sensor circuit 75 (individually identified as 75A, 75B, and 75C) is connected in series with one filter in each gap. The sensor circuit in each gap is connected in series with a filter having a different passband from the sensor circuits connected in other gaps. In the illustrated embodiment, sensor circuit 75A is connected in series with filter 78 across gap 77A; sensor circuit 75B is connected in series with filter 79 across gap 77B and sensor circuit 75C is connected in series with filter 80 across gap 77C.

Probe 24 can selectively interrogate the different sensors 75A, 75B and 75C by selecting a different signal frequency or combination of frequencies. For example, sensor circuit 75A can be interrogated by selecting a signal in the passband of filter 78. Sensor circuit 75B can be interrogated by selecting a signal in the passband of filter 79. Sensor circuit 75C can be interrogated by selecting a signal in the passband of filter 80. The different sensors may be interrogated simultaneously or at different times.

In some embodiments, drill string 12 may comprise more than one gap sub assembly 20 positioned a distance apart from each other. Advantageously, an uphole one of gap-sub assemblies 20 is located above a formation that is poor for EM telemetry (e.g. a formation that has high electrical conductivity). Such embodiments may be advantageous for facilitating relatively low noise, low power telemetry to and from the surface from an electronics package in a probe, pocket or the like located at the uphole gap sub assembly 20. Other gap sub assemblies may be spaced apart along the drill string below the uppermost gap sub assembly by distances sufficiently small to permit reliable communication among electronics packages located at the gap sub assemblies. For example, the gap sub assemblies below the uppermost gap sub assembly may be separated by distances on the order of about 10 meters to about 1000 meters. In some embodiments gap sub assemblies may be separated by distances of 3 meters to 30 meters.

The uppermost electronics package and gap sub assembly 20 may be spaced apart from the surface by a greater distance than it is separated from the gap sub assemblies below it. In other embodiments gap sub assemblies are spaced apart more or less equally along the drill string. In other embodiments, gap sub assemblies are spaced apart along the drill string by distances that take into account knowledge of the attenuation characteristics of surrounding formations (gap sub assemblies may be more closely-spaced in regions where attenuation is higher and more widely spaced apart in other regions). In some embodiments the gap sub assemblies are spaced apart by distances in the range of 3 meters to 300 meters, 3 meters to 50 meters in some embodiments.

In some embodiments, gap sub assemblies are spaced closely enough together along the drill string to relay data from downhole locations at or near a BHA to surface equipment by EM telemetry using frequencies of 100 Hz or higher. Although such high frequencies can be attenuated significantly in the downhole environment the relatively close spacing of gap sub assemblies and associated EM receivers and EM signal generators allows EM signals from one of the gap sub assemblies to be received at another gap sub assembly further uphole before it is too attenuated to be reliably detected.

One advantage of providing relatively closely-spaced gap sub assemblies and associated electronics packages all along the drill string is that data can be relayed to the surface using higher frequencies (and commensurately higher data rates) than would be practical for EM telemetry from a location in the BHA to the surface in one hop. Thus, such a system may provide faster communication of data to the surface and/or a higher data rate than would be possible using a conventional EM telemetry system.

In some embodiments, some or all of the sections of drill string 12 are electrically isolated from each other by gap sub assemblies 20 and may comprise one or more electrically insulated pockets. Such pockets may be used to house any one of downhole sensors, power sources, transceivers, other electrical equipment used in downhole drilling or a combination thereof. Some or all of the electrically insulating pockets may be electrically connected to one another across gap sub assemblies 20 for direct electrical communication. Such communication may be established via direct insulated wiring housed within channels 20D, 20E that extend to a gap within the uphole portion 20A and downhole portion 20B of each of gap sub assembly 20 along drill string 12. The channels may directly connect adjacent pockets separated by a single gap or they may directly connect pockets separated by more than one gap.

As described above, a drill string may include multiple electronics packages which are networked together at least in part by signals that propagate across gaps. The gaps may optionally be used to separate parts of the drill string being used for transmission of EM telemetry signals. In some embodiments, electronics packages are distributed along a drill string. Some or all of the electronics packages may comprise sensors and/or be connected to receive sensor output values. Example embodiments may include sensors that measure parameters such as torque, shock, vibration drag, tension, compression, rotation or the like at locations spaced apart along the drillstring. The collected information may be transmitted to the surface from one or more of the electronics packages.

Optionally some data is transmitted to the surface by way of two or more electronics packages. For example data may be collected at a first electronics package and transmitted to a second electronics package in a manner as described herein. The first electronics package may be deep enough in a wellbore that data that it transmits at a given frequency is not received at the surface. The data may be received at the second electronics package (for example using any of the data transmission methodologies discussed above). The second electronics package may retransmit the data to the surface (possibly together with data acquired by sensors at the second electronics package and/or data received at the second electronics package from one or more additional electronics packages). The second electronics package may identify the source(s) of the data that it retransmits. For example, different sources (electronics packages) may transmit data to the second electronics package on different frequencies. The second electronics package may label the data to indicate its source before retransmitting the data. The second electronics package may process data before retransmitting the data. For example, the second electronics package may compress together data from one or more sources, compute averages or other statistical properties of receive data (and transmit those) etc.

In some embodiments, data is passed up the drill string from downhole electronics packages to a furthest uphole electronics package which passes the data to surface equipment. One or more of the electronics packages en route may optionally assemble data sourced from a plurality of electronics packages into a "summative telemetry" comprising all values and the related nodes at which the values were collected. The different electronics packages may transmit data using the same and/or different frequencies and/or encoding schemes and/or data compression methods.

Embodiments of the invention may employ any suitable scheme for encoding data in an EM telemetry signal. One such scheme is QPSK (quadrature phase shift keying). Another scheme is BPSK (binary phase shift keying). A PSK (phase-shift keying) encoding scheme may use a number of cycles (at the current frequency) to transmit each symbol. The number of cycles used to transmit each symbol may be varied. For example, in low-noise environments one may be able to successfully transmit EM telemetry symbols using two cycles per symbol. In higher noise environments it may be desirable or necessary to use three cycles (or more) to transmit each symbol. In some embodiments the number of cycles to be used to encode a symbol is selected based on a measured signal-to-noise ratio (SNR) in a recent sweep. Other encoding schemes include FSK (frequency-shift keying), QAM (quadrature amplitude modulation), 8ASK (8 amplitude shift keying), APSK (amplitude phase shift keying) etc. Schemes which use any suitable combinations of changes in phase, amplitude, timing of pulses and/or frequency to communicate data may be applied.

In some embodiments, the electronics package that assembles data for transmission to the surface equipment may be configured to add additional data such as: node (depth location in the BHA); information related to the specific frequency transmission it is receiving (e.g. information identifying the frequency and the corresponding node (gap or electronics package) with which that frequency is related). Signal strength of received data transmissions at different frequencies may also be recorded and transmitted to the surface equipment.

Another aspect of the current disclosure provides methods for transmitting data across a gap in a gap sub assembly. According to an example embodiment, the method comprises providing a gap sub having an uphole portion 20A and a downhole portion 20B separated by an electrically-insulating gap 20C. Gap 20C is filled with a suitable dielectric material. The method involves applying a low-frequency AC signal across the gap to perform EM telemetry and simultaneously or at a different time applying a higher-frequency signal across the gap having a frequency sufficient to cross the gap. The method may include modulating the applied higher-frequency signal to encode a sensor reading. The encoded sensor reading may be received by an electronics package in a probe, pocket or the like and interpreted, transmitted or the like.

Another aspect of the invention provides a method for data telemetry from a downhole electronics package connected to apply EM telemetry signals across a gap in a drillstring. The gap may be provided by a gap sub connected in the drillstring. One or more other gaps are located downhole from the electronics package. The other gaps provide electrical impedance at frequencies of the EM telemetry signals. The method comprises closing switches to reduce the electrical impedance of the other gaps at least at frequencies of the EM telemetry signals. The switches may be connected to create short circuits across the other gaps. In an example embodiment the switches are electrically controlled and are automatically closed in response to a signal or signals from the electronics package. In some embodiments, the switches are automatically closed in response to detection of the EM telemetry signals.

At the other (downhole) gap or gaps, control circuits may monitor for signals across the gap or gaps. In response to detecting a signal at a frequency corresponding to the EM telemetry signals the control circuits may close the switches for a period of time.

In some embodiments the drillstring may include a number of gaps which successively relay data until the data is received at surface equipment. In some such embodiments, the method involves closing switches to reduce the impedance of the other gaps downhole from the gap from which the data is currently being transmitted. The data is successively re-transmitted using gaps uphole from the closed switches. As noted above, the data may be aggregated with other data as it is transmitted uphole.

Different EM telemetry signal generators may be configured to generate distinguishable EM telemetry signals (for example signals at different frequencies). Control circuits at gaps along the drillstring may be configured to determine whether or not to close a switch to reduce impedance of a corresponding gap based on analysis of received EM telemetry signals. In an alternative embodiment, EM telemetry signal generators are configured to generate control signals which are received at control circuits at other gaps and used by those control circuits to determine whether ort not to close a switch to alter electrical impedance of the corresponding gap. The control signals may differ (in frequency and/or other respects) from the EM telemetry signals.

Various of the embodiments described above include a conductor 22 that extends along a drill string. Conductor 22 may cross one or more gaps. It is not necessary for conductor 22 to extend the full length of a drill string 12. In some embodiments conductor 22 extends only within a gap sub assembly to provide a current path between electronics on either side of a gap. In some embodiments, conductor 22 extends along a portion of drill string 12 that is short relative to a total length of the drill string. In some embodiments conductor 22 extends along a BHA and interconnects various electronics packages in and around the BHA. In some embodiments a drill string has a plurality of conductors 22 which each extend along a part of the drill string.

The present disclosure provides a variety of constructions for establishing signal connections among downhole electronics packages and/or between downhole electronics packages and surface equipment. These include, without limitation, connections across electrically-insulating gaps in a drill string made by way of: insulated electrical conductors, filters, inductive couplings, switches and direct transmission (e.g. using electrical properties of the gap as a high-pass filter). Additional components such as filters, switches, sensors etc. may be provided in the gap itself, in a pocket formed adjacent to the gap, in a probe that spans the gap, and/or in a sleeve in the bore of the drillstring that spans the gap. These connections may be applied individually or together in any suitable combinations to provide desired signal connectivity. The example embodiments described herein and illustrated in the drawings are not intended to illustrate the full range of possible combinations of the described signal interconnection technologies. Those of skill in the art will understand that a downhole system for a particular application may use one or any combination or sub-combination of such technologies to establish communication between different downhole electronics.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those of skill in the art. The invention in its broader aspects is therefore not limited to the specific details, representative apparatus and methods, and illustrative examples shown and described.

Certain modifications, permutations, additions and sub-combinations thereof are inventive and useful and are part of the invention. It is therefore intended that the following appended claims and claims hereafter introduced are interpreted to include all such modifications, permutations, additions and sub-combinations as are within their true spirit and scope.

Interpretation of Terms

The word 'gap' as used herein means a gap in electrical conductivity of a drillstring, probe or other structure at least at some frequency or frequency band. The term gap does not require a physical opening or absence of matter. A gap may, for example, be provided by a dielectric material which provides a mechanical connection between two electrically-conductive parts of a drillstring or drillstring section. A gap may be provided by a gap sub configured to be coupled into a drillstring.

Unless the context clearly requires otherwise, throughout the description and the claims:

"comprise," "comprising," and the like are to be construed in an inclusive sense, as opposed to an exclusive or exhaustive sense; that is to say, in the sense of "including, but not limited to".

"connected," "coupled," or any variant thereof, means any connection or coupling, either direct or indirect, between two or more elements; the coupling or connection between the elements can be physical, logical, or a combination thereof.

"herein," "above," "below," and words of similar import, when used to describe this specification shall refer to this specification as a whole and not to any particular portions of this specification.

"or," in reference to a list of two or more items, covers all of the following interpretations of the word: any of the items in the list, all of the items in the list, and any combination of the items in the list.

the singular forms "a," "an," and "the" also include the meaning of any appropriate plural forms.

Words that indicate directions such as "vertical," "transverse," "horizontal," "upward," "downward," "forward," "backward," "inward," "outward," "vertical," "transverse," "left," "right," "front," "back", "top," "bottom," "below," "above," "under," and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g., an assembly, circuit, body, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

The invention claimed is:

1. An apparatus comprising:

a drill string comprising a plurality of electrically-insulating gaps spaced apart along the drill string; and a plurality of EM telemetry signal generators, each of the plurality of EM signal generators electrically coupled across a corresponding one of the plurality of gaps to apply an EM telemetry signal across the corresponding one of the plurality of gaps;

wherein a first one of the plurality of gaps has a high first electrical impedance in a first frequency band, a first one of the EM telemetry signal generators of the plurality of EM signal generators is configured to transmit EM telemetry signals in the first frequency band and is coupled to apply the EM telemetry signals in the first frequency band across the first one of the plurality of gaps, and the other ones of the plurality of gaps have electrical impedances in the first frequency band that are lower than the first electrical impedance.

2. The apparatus according to claim 1 comprising an electrical high-pass or bandpass filter electrically connected across one of the gaps.

3. The apparatus according to claim 2 wherein the filter comprises one or more capacitors connected between an electrically conductive portion of the drill string uphole from the gap and an electrically conductive portion of the drill string downhole from the gap.

4. The apparatus according to claim 2 wherein the filter comprises an inductive coupling.

5. The apparatus according to claim 2 comprising a sensor circuit connected in series with the filter.

6. The apparatus according to claim 1 wherein each of one or more of the other ones of the plurality of gaps has a high electrical impedance in a corresponding other frequency band different from the first frequency band, and the EM telemetry signal generator corresponding to each one of the one or more of the other ones of the plurality of gaps is configured to transmit EM telemetry signals in the corresponding other frequency band corresponding to the respective one of the one or more of the other ones of the gaps.

7. The apparatus according to claim 6 comprising an EM telemetry receiver electrically connected across the first one of the gaps.

8. The apparatus according to claim 6 comprising an EM telemetry receiver connected across the one of the other ones of the plurality of gaps.

9. The apparatus according to claim 1 wherein each of the other ones of the plurality of gaps has a corresponding electrical filter coupled across it, each corresponding electrical filter configured to pass the first frequency band.

10. The apparatus according to claim 9 wherein the other ones of the plurality of gaps includes at least two gaps and the corresponding electrical filters respectively coupled across each one of the at least two gaps have filter characteristics different from one another.

11. The apparatus according to claim 10 wherein the corresponding electrical filters respectively coupled across the at least two gaps include at least one low-pass filter and at least one band-pass filter.

12. The apparatus according to claim 9 wherein the other ones of the plurality of gaps comprises at least one gap and the electrical filter coupled across the at least one gap is a low-pass filter.

13. The apparatus according to claim 12 wherein the low-pass filter has a passband extending to at least 20 Hz.

14. The apparatus according to claim 1 wherein the first one of the gaps is uphole in the drill string from the other ones of the plurality of gaps.

15. The apparatus according to claim 6 comprising a first EM telemetry receiver at the first one of the gaps.

16. The apparatus according to claim 15 comprising a first electronics package, the first electronics package comprising the first EM telemetry signal generator and the first EM telemetry receiver and a second electronics package, the second electronics package comprising a second EM telemetry signal generator of the plurality of EM signal generators associated with a second one of the gaps.

17. The apparatus according to claim 16 wherein the second electronics package is configured to control the second EM telemetry transmitter to transmit second data comprising one or more second values at a second frequency; and the first electronics package is configured to receive the second data from the first EM telemetry receiver, to combine one or more first values with the one or more second values to yield first data, and to transmit the first data at a first frequency in the first frequency band that is different from the second frequency using the first EM telemetry transmitter.

18. The apparatus according to claim 17 wherein the first electronics package is configured to include in the first data information identifying at least one of the second frequency and an identity of the second electronics package.

19. The apparatus according to claim 1 comprising an electrically-controlled switch connected across one of the gaps.

20. The apparatus according to claim 19 comprising a filter connected in series with the electrically-controlled switch.

21. The apparatus according to claim 19 comprising a sensor or sensor circuit connected in series with the electrically-controlled switch.

22. The apparatus according to claim 1 wherein the EM signal generators are each provided in one of a plurality of electronics packages coupled to the drill string at locations spaced apart from one another along the drill string, each of the plurality of electronics packages comprising the corresponding EM telemetry signal generator, the plurality of electronics packages including at least:

a first electronics package configured to generate first EM signals by way of the corresponding EM telemetry signal generator at a first frequency or set of frequencies, the first EM signals encoding first data; and a second electronics package comprising an EM signal detector configured to receive the first EM signals, the second electronics package further configured to generate second EM signals by way of the corresponding EM telemetry signal generator at a second frequency or set of frequencies that are different from the first frequency or set of frequencies, the second EM signals encoding the first data.

23. The apparatus according to claim 22 wherein the second electronics package comprises one or more sensors and is configured to additionally encode data related to readings from the one or more sensors in the second EM signals.

24. The apparatus according to claim 22 wherein the second electronics package is configured to encode in the second EM signals data indicating a source of the first data based on the first frequency or set of frequencies.

25. The apparatus according to claim 22 wherein the first electronics package is configured to encode the first data in the first EM signal using a first encoding scheme and the second electronics package is configured to encode data in the second EM signal using a second encoding scheme that is different from the first encoding scheme.

26. The apparatus according to claim 25 wherein the first encoding scheme is selected from the group consisting of FSK, PSK, QPSK, BPSK, APSK, and 8ASK.

27. The according to claim 22 wherein the first and second electronics packages are separated by a distance in the range of 3 meters to 200 meters.

28. The apparatus according to claim 22 wherein the second frequency is lower than the first frequency.

29. The apparatus according to claim 28 wherein the second frequency is 20 Hz or lower.

30. The apparatus according to claim 29 wherein the first frequency is 100 Hz or higher.

31. The apparatus according to claim 22 wherein the EM signal generator of the first electronics package is connected across a first one of the gaps and the EM signal generator of the second electronics package is connected across a second one of the gaps.

32. The apparatus according to claim 31 wherein the first gap provides a higher electrical impedance at the first frequency or set of frequencies and a lower electrical impedance at the second frequency or set of frequencies.

33. The apparatus according to claim 32 comprising an electrical filter connected across the first gap, the electrical filter configured to pass the second frequency or set of frequencies.

34. The apparatus according to claim 33 wherein the electrical filter comprises a low-pass filter.

35. The apparatus according to claim 34 wherein the low-pass filter comprises a capacitor connected across the first gap.

36. The apparatus according to claim 22 wherein the plurality of electronics packages comprises a third electronics package configured to generate third EM signals by way of the corresponding EM telemetry signal generator at a third frequency or set of frequencies, the third EM signals encoding third data wherein the EM signal detector is configured to receive the third EM signals and the second electronics package is configured to additionally encode the third data in the second EM signals.

37. The apparatus according to claim 36 wherein the first gap provides a higher electrical impedance at the first frequency or set of frequencies and a lower electrical impedance at the second frequency or set of frequencies and the third frequency or set of frequencies.

38. The apparatus according to claim 37 wherein the third gap provides a higher electrical impedance at the third frequency or set of frequencies and a lower electrical impedance at the second frequency or set of frequencies and the first frequency or set of frequencies.

39. The apparatus according to claim 22 wherein the plurality of electronics packages comprise electronics packages downhole from the second electronics package and spaced apart from one another by distances of less than 300 meters in the entire portion of the drill string between the second electronics package and a bottom hole assembly of the drill string.

40. The apparatus according to claim 39 wherein the electronics packages below the second electronics package are configured to transfer data from sensors located in the bottom hole assembly to the second electronics package by way of EM signals having frequencies exceeding 100 Hz.

41. The apparatus according to claim 1 comprising an electrically-controlled switch connected across one of the gaps and a control circuit connected to control the electrically-controlled switch, wherein the control circuit is configured to close the electrically-controlled switch in response to detection of a signal at a transmitting frequency of the EM telemetry signal generator connected across another one of the gaps.

42. The apparatus according to claim 1 wherein each of a plurality of the gaps downhole from one of the EM telemetry signal generators has an electrically-controlled switch connected across it and a control circuit connected to control the electrically-controlled switch, wherein the control circuit is configured to close the electrically-controlled switch in response to detection of a signal at the corresponding gap.

* * * * *